US012566026B2

(12) United States Patent
Liu et al.

(10) Patent No.: US 12,566,026 B2
(45) Date of Patent: Mar. 3, 2026

(54) REFRIGERATION APPLIANCE

(71) Applicant: BSH Hausgeräte GmbH, Munich (DE)

(72) Inventors: Junxin Liu, Nanjing (CN); Bo Ma, Nanjing (CN); Jiahao Zhang, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 81 days.

(21) Appl. No.: 18/697,224

(22) PCT Filed: Sep. 7, 2022

(86) PCT No.: PCT/EP2022/074813
§ 371 (c)(1),
(2) Date: Mar. 29, 2024

(87) PCT Pub. No.: WO2023/052059
PCT Pub. Date: Apr. 6, 2023

(65) Prior Publication Data

US 2024/0401874 A1 Dec. 5, 2024

(30) Foreign Application Priority Data

Sep. 29, 2021 (CN) ..... 202111150502.9

(51) Int. Cl.
*F25D 27/00* (2006.01)
*F25D 25/02* (2006.01)

(52) U.S. Cl.
CPC ..... *F25D 27/00* (2013.01); *F25D 25/02* (2013.01); *F25D 2400/40* (2013.01)

(58) Field of Classification Search
CPC ..... F25D 27/00; F25D 27/005; F25D 25/02; F25D 2327/00; F25D 2400/40
See application file for complete search history.

(56) References Cited

U.S. PATENT DOCUMENTS 3,506,325 A 4/1970 Horvay
6,042,244 A * 3/2000 Witkoski ..... A47F 11/10 362/394

(Continued)

FOREIGN PATENT DOCUMENTS

CN 107270645 A * 10/2017 ..... F25D 25/02
CN 207922683 U * 9/2018

(Continued)

*Primary Examiner* — Andrew Roersma
(74) *Attorney, Agent, or Firm* — Laurence A. Greenberg; Werner H. Stemer; Ralph E. Locher

(57) ABSTRACT

A refrigeration appliance includes a storage compartment having opposite side walls and a rear wall therebetween. Each side wall includes a mounting portion. A shelf assembly is mounted on the storage compartment by the mounting portion and moves along a front-rear direction of the storage compartment limited by the mounting portion. The shelf assembly includes at least two first conductive terminals, and the first conductive terminal is located at a rear portion of the shelf assembly. A light source assembly on the shelf assembly includes a circuit substrate and a light source on the circuit substrate. A power supply portion located at a rear portion of the storage compartment supplies power to the light source and includes power supply terminal units on the rear wall close to corresponding side walls. The first conductive terminal maintains electrical connection with the power supply terminal unit due to the mounting portion.

13 Claims, 15 Drawing Sheets

(56) References Cited

U.S. PATENT DOCUMENTS

| | | | | |
|---|---|---|---|---|
| 7,107,779 | B2 * | 9/2006 | Avenwedde | F21V 23/06 62/264 |
| 7,163,305 | B2 * | 1/2007 | Bienick | A47F 11/10 362/125 |
| 7,628,525 | B2 * | 12/2009 | Lee | F25D 27/00 362/602 |
| 8,459,817 | B2 * | 6/2013 | Alberghetti | F21V 33/0012 62/264 |
| 8,944,621 | B2 * | 2/2015 | Driver | A47B 96/028 362/249.05 |
| 9,443,671 | B2 * | 9/2016 | Goodwin | F25D 29/005 |
| 9,601,881 | B2 * | 3/2017 | Lee | H01R 13/42 |
| 10,139,155 | B2 | 11/2018 | Lee et al. | |
| 10,222,055 | B2 * | 3/2019 | Pan | F21V 23/04 |
| 10,340,741 | B2 * | 7/2019 | Lee | F25D 29/008 |

FOREIGN PATENT DOCUMENTS

| | | | | | |
|---|---|---|---|---|---|
| CN | 110108084 | A | * | 8/2019 | F25D 25/02 |
| CN | 110285640 | A | * | 9/2019 | F25D 25/02 |
| CN | 106895653 | B | * | 1/2020 | F25D 11/02 |
| CN | 111380320 | A | * | 7/2020 | F21V 33/0044 |
| EP | 3032200 | A1 | | 6/2016 | |
| EP | 3225942 | A1 | | 10/2017 | |
| FR | 2891446 | A1 | | 4/2007 | |
| KR | 101713325 | B1 | * | 3/2017 | F25D 23/00 |

* cited by examiner

REFRIGERATION APPLIANCE

TECHNICAL FIELD

This application relates to household appliances, and in particular, to a refrigeration appliance.

BACKGROUND

A shelf assembly is arranged in a storage compartment of some existing refrigeration appliances, but the shelf assembly may not be connected to the storage compartment conveniently and reliably.

SUMMARY

An objective of this application is to provide an improved refrigeration appliance.

For the above objective, one aspect of embodiments of this application provides a refrigeration appliance including: a storage compartment, which is provided with a pair of opposite side walls and a rear wall between the side walls, where each of the side walls includes a mounting portion; a shelf assembly, which is mounted on the storage compartment by the mounting portion and whose movement along a front-rear direction of the storage compartment is limited by the mounting portion, the shelf assembly including at least two first conductive terminals, and the first conductive terminal is located at a rear portion of the shelf assembly; a light source assembly, which includes a circuit substrate and a light source located on the circuit substrate, where the light source assembly is disposed on the shelf assembly; and a power supply portion, which is located at a rear portion of the storage compartment to supply power to the light source, where the power supply portion includes power supply terminal units respectively close to the corresponding side walls, the power supply terminal unit is disposed on the rear wall, and the first conductive terminal maintains electrical connection with the power supply terminal unit by means of the mounting portion.

In this way, it can be facilitated a convenient and reliable connection between the shelf assembly and the storage compartment and the like. For example, the first conductive terminal at the rear portion of the shelf assembly is electrically connected to the power supply terminal unit at the rear portion of the storage compartment, and the reliable electrical connection between the two is maintained by mating of the mounting portion located at the side wall and the shelf assembly, which can facilitate the connection after the shelf assembly is inserted into the storage compartment from the front to the rear, and the reliable connection is maintained by the limitation to the shelf assembly by the mounting portion, which is relatively convenient. The shelf assembly is electrically connected to the power supply terminal unit through at least two first conductive terminals respectively, which can contribute to reliability of the connection and provide some possibilities, for example, make the first conductive terminals have different polarities, such as positive or negative, to reduce the possibility of liquid-like substances communicating the first conductive terminals with the power supply terminal unit, thereby improving the safety of the refrigeration appliance. In addition, the movement of the shelf assembly in the front-rear direction along the storage compartment is limited by the mounting portion, which can facilitate reliability of the connection.

In a possible embodiment, the refrigeration appliance includes an elastic member located in the shelf assembly, where the at least two first conductive terminals maintain electrical connection with the corresponding power supply terminal units respectively under the action of the elastic member. When the shelf assembly is mounted on the mounting portion, the elastic member can apply a force toward the power supply terminal unit to an end of the first conductive terminal. On the other hand, both sides of the shelf assembly are limited by the mounting portion, so that reliable connection between the first conductive terminal and the power supply terminal unit can be maintained. In this way, it can be beneficial to guarantee the reliability of the electrical connection between the at least two first conductive terminals and the corresponding power supply terminal units, avoiding the inability and poor connection due to tolerances in size, position and the like. The elastic member may be a spring. The elastic member, the at least two first conductive terminals, and the corresponding power supply terminal units may be in the same quantity and in one-to-one correspondence. When the shelf assembly is mounted on the mounting portion, the elastic member is compressed, so that the end of the first conductive terminal abuts against the power supply terminal unit.

In a possible embodiment, each of the at least two first conductive terminals includes the elastic member. In this way, it can be beneficial to guarantee reliable connection of each of the at least two first conductive terminals.

In a possible embodiment, each of the at least two first conductive terminals includes a terminal base and a terminal head movable relative to the terminal base, and the terminal head abuts against the corresponding power supply terminal unit under the action of the mounting portion. In this way, it can be beneficial to guarantee the reliability of the electrical connection between the at least two first conductive terminals and the corresponding power supply terminal units. Specifically, the mounting portion may facilitate holding the shelf assembly at a position where the terminal head abuts against the corresponding power supply terminal unit are. The relative movement of the terminal head and the terminal base may help the shelf assembly maintain a margin at the position where the terminal head abuts against the corresponding power supply terminal unit.

In a possible embodiment, each of the at least two first conductive terminals includes an elastic member located between the terminal base and the terminal head, and the elastic member is adapted to apply a force toward the corresponding power supply terminal unit to the terminal head, so that the terminal head abuts against the power supply terminal unit. In this way, it can be beneficial to guarantee the reliability of the electrical connection between the at least two first conductive terminals and the corresponding power supply terminal units. The elastic member may be in a compressed state or a stretched state, so that its corresponding resilient force provides a force for the terminal head to abut against the power supply terminal unit.

In a possible embodiment, the terminal base is in the shape of a hollow tube, and the terminal head is inserted into the terminal base and adapted to move along the terminal base. In this way, it can be beneficial to facilitate relative movement and reliable connection between the terminal base 38 and the terminal head 40 and control the movement trajectory of the terminal head 40.

In a possible embodiment, the terminal head may be a cylinder with an outer diameter less than and equal to an inner diameter of the terminal base. The terminal head may be solid. In the process of mounting the shelf assembly in the storage compartment, the terminal head moves relative to the terminal base during contact with the power supply terminal unit, and the position of the terminal head relative to the terminal base is determined by the position of the shelf assembly in the storage compartment when the mounting of the shelf assembly is completed, thereby achieving the reliable connection between the terminal head and the power supply terminal unit.

In a possible embodiment, the refrigeration appliance includes a second conductive terminal disposed on the circuit substrate, and the terminal base is electrically connected to the second conductive terminal. In this way, it can facilitate the electrical connection between the first conductive terminal and the second conductive terminal to supply power to the circuit substrate and the light source.

In a possible embodiment, the first conductive terminal is perpendicular to the circuit substrate.

In a possible embodiment, the first conductive terminal may extend along the front-rear direction, and the circuit substrate is parallel to the rear wall of the storage compartment and/or the front opening of the storage compartment. In this way, it can be beneficial to establish the connection between the first conductive terminal and the second conductive terminal on the circuit substrate, and facilitate the reliability of the electrical connection between the first conductive terminal and the circuit substrate.

In a possible embodiment, the refrigeration appliance includes a second conductive terminal connected to the circuit substrate, and the first conductive terminal and the second conductive terminal are plugged and connected along a direction perpendicular to the circuit substrate. In this way, the reliability of the conductive connection between the first conductive terminal and the circuit substrate can be further improved.

In a possible embodiment, the second conductive terminal is located on a first side of the circuit substrate away from the rear wall, and the first conductive terminal is connected to the second conductive terminal through the circuit substrate. In this way, the space occupied at a rear portion of the circuit substrate by the second conductive terminal can be reduced, which is beneficial to improve space utilization of the shelf assembly.

In a possible embodiment, the shelf assembly includes a retaining wall located between the second conductive terminal and the light source along a vertical direction. In this way, it can be beneficial to prevent the combination between the second conductive terminal and the first conductive terminal from possibly causing damage to the light source and avoiding unnecessary diffusion of light emitted by the light source.

In a possible embodiment, the second conductive terminal includes a mounting portion mounted on the circuit substrate and a holding portion configured to be inserted with the first conductive terminal, and at least one side wall of the holding portion is elastic. In this way, it can be beneficial to facilitate convenient and reliable connection between the first conductive terminal and the second conductive terminal, reduce or eliminate wobble of the first conductive terminal, provide a margin at a relative position of the first conductive terminal and the second conductive terminal, and connect the first conductive terminal and the circuit substrate by means of the second conductive terminal. The mounting portion may be sheet-shaped. The holding portion may at least partially surround the first conductive terminal.

In a possible embodiment, the refrigeration appliance includes a second conductive terminal connected to the circuit substrate, and the second conductive terminal is mounted on a second side of the circuit substrate facing the rear wall, and the first conductive terminal is electrically connected to the second conductive terminal. In this way, it can be beneficial for mounting of the second conductive terminal and the light source on different sides of the circuit substrate, so as to reduce and avoid the impact of the connection between the first conductive terminal and the second conductive terminal on the light source.

In a possible embodiment, the refrigeration appliance includes a second conductive terminal connected to the circuit substrate, and the first conductive terminal and the second conductive terminal are plugged and connected along a direction perpendicular to the circuit substrate on which the light source is mounted. In this way, it can be beneficial to save space on the circuit substrate, reduce the size of the circuit substrate, and increase the effective space utilization of the shelf assembly.

In a possible embodiment, the shelf assembly includes a frame for accommodating the light source, the first conductive terminal is mounted on an insulator, and the insulator is immovably fixed to the frame. In this way, it can be beneficial for fixing and mounting of the first conductive terminal on the shelf assembly. The insulator can be fixed to the frame by ultrasonic welding. A portion of the insulator in contact with the frame may be approximately square block-shaped. The insulator may include an approximately cylindrical cylinder portion extending from the square block-shaped portion toward the rear wall. The insulator may be provided with a through hole in the middle to allow the first conductive terminal to pass through. The surface of the side of the insulator close to the frame may be partially recessed to accommodate a gasket in contact with the first conductive terminal. The insulator may be combined with a portion of the terminal base extending from the frame to provide support therefor.

In a possible embodiment, the refrigeration appliance includes an air duct located at the rear portion of the storage compartment, where the rear wall includes an air duct cover, the air duct cover includes at least one vent communicating the air duct with the storage compartment, and the power supply terminal unit is located on the air duct cover. In this way, it can be beneficial to avoid drastically changing processing mold, production process and the like of the refrigeration appliance, such as the processing mold, production process and the like of the liner of the refrigeration appliance, so as to control the cost of the refrigeration appliance.

In a possible embodiment, the power supply terminal unit includes a first power supply terminal unit and a second power supply terminal unit, a first distance between the first power supply terminal unit and the corresponding mounting portion in a lateral direction of the storage compartment is equal to a second distance between the second power supply terminal unit and the corresponding mounting portion in the lateral direction of the storage compartment, and the first distance and the second distance are respectively less than a third distance between the first power supply terminal unit and a lateral centerline of the rear wall and a fourth distance between the second power supply terminal unit and the lateral centerline of the rear wall. In this way, it can be beneficial for the shelf assembly to receive uniform force when combined with the mounting portions of the two side walls, and the combination between the shelf assembly and the mounting portions of the two side walls can assist in maintaining the connection between the first conductive terminal and the first power supply terminal unit as well as the second power supply terminal unit. The lateral direction of the storage compartment may be oriented from one side wall to the other side wall.

In a possible embodiment, one of the first power supply terminal unit and the second power supply terminal unit is a positive electrode, and the other is a negative electrode. In this way, it can be beneficial to keep the positive and negative electrodes separate and away from each other, to avoid short circuit of the positive and negative electrodes by, for example, solutions.

In a possible embodiment, the power supply terminal unit includes an insulating housing connected to the rear wall, the insulating housing includes a mounting plate, the power supply terminal unit includes a sheet-shaped first connection portion disposed along a front side of the mounting plate and a second connection portion located at a rear portion of the mounting plate, the first connection portion is connected to the first conductive terminal, and the second connection portion is connected to a mating connector located in the rear wall. In this way, it can be beneficial to mount and fix the power supply terminal unit and the rear wall, the surface of the rear wall toward the storage compartment may be approximately flat and aesthetically pleasing in appearance, and the refrigeration appliance may supply power to the light source of the shelf assembly through the mating connector and the power supply terminal unit.

In a possible embodiment, the second connection portion is sheet-shaped and is affixed to a plug portion of the insulating housing, and the second connection portion, the plug portion of the insulating housing, and the mating connector are plugged and connected. In this way, it can be beneficial to facilitate convenient and reliable connection between the power supply terminal unit and the mating connector.

In a possible embodiment, the second connection portion and the plug portion of the insulating housing extend rearward. In this way, it can be beneficial that the second connection portion and the plug portion of the insulating housing are at least partially located outside of the storage compartment, not occupying the storage space of the storage compartment and increasing the effective space utilization of the storage compartment. In addition, the surface of the rear wall toward the storage compartment may be approximately flat and aesthetically pleasing in appearance.

In a possible embodiment, the rear wall includes an opening for mounting an insulating housing of the power supply terminal unit, the rear wall includes a first bevel surrounding the opening, the insulating housing includes a second bevel, and the first bevel and the second bevel abut against each other. In this way, it can be beneficial to facilitate convenient and reliable connection between the power supply terminal unit and the rear wall.

In a possible embodiment, the power supply terminal unit includes a sealing strip, and the sealing strip is extruded against the first bevel and/or the second bevel. In this way, it can be beneficial to prevent penetration and leakage of water and other liquids.

In a possible embodiment, the power supply terminal unit includes a sheet-shaped first connection portion, which faces a front opening of the storage compartment. In this way, it can be beneficial to facilitate the surface of the rear wall toward the storage compartment may be approximately flat and aesthetically pleasing in appearance, and, it can be beneficial to connect the first conductive terminal to the power supply terminal unit after the shelf assembly is mounted on the mounting portion. In addition, the shelf assembly may at least partially shield the power supply terminal unit, avoid unintentional damage and contribute to aesthetics of the storage compartment.

In a possible embodiment, the mounting portion includes a clamping portion, and the shelf assembly includes a light-guiding glass plate, a frame disposed along a rear edge of the glass plate, and a pair of covers respectively connected to corresponding ends of the frame, the cover is clamped in the clamping portion, and the light source is located in the frame. In this way, it can be beneficial to mount the shelf assembly on the mounting portion by means of the cover and the clamping portion, and the light emitted by the light source in the frame connected to the rear edge of the glass panel may be guided forward along the glass panel. The glass plate may be rectangular, square, and other forms. The glass panel may have front, rear, left, and right oriented end faces facing the front opening, the rear wall, the left side wall, and right side wall of the storage compartment respectively. For example, when the frame including the light source is disposed on the rear edge of the glass panel, the light emitted by the light source may be incident from the rear end face of the glass panel and at least partially emergent from the front, left, and right end faces. In this case, the rear end face may be an incident end face, and the end faces in the other three directions may be emergent end faces.

In a possible embodiment, the end faces of the glass panel may all be frosted so that the glass panel may not need to distinguish between front and rear sides, and manufacturing may be simpler and the process may be easier to achieve, while the cost of the glass panel may be lower. The lighting effect may be relatively uniform, and scratches and fingerprint soiling can also be avoided.

In some other embodiments, the incident end face of the glass panel, such as the rear end face, may be smooth, while the emergent end face, such as the front, left, and right end faces, may be frosted. In this way, the lighting effect of the incident end face may be higher and brighter, while the lighting effect of the emergent end faces may be relatively uniform, and scratches and fingerprint soiling can also be avoided. An upper surface and a lower surface of the glass panel may present a luminous pattern, such as a luminous LOGO, by printing, laser engraving, stickers, and the like. Two ends of the frame may be symmetrically provided with a welding platform/gluing groove, and the two covers may each be provided with corresponding welding bars/sealing glue bars to be mounted and fixed to the corresponding ends of the frame respectively. The clamping portion may be an approximately C-shaped protrusion with a front opening, so that the cover may enter the clamping portion after the shelf assembly is inserted from the front to the rear. The shelf assembly may be unbounded from the rear to the front to the mounting portion. The rear edge of the clamping portion may limit further rearward movement of the shelf assembly. The rear edge of the clamping portion may be at a distance from the rear wall in the front-rear direction, so as to define an extension space between the frame and the rear wall for the portion of the first conductive terminal located outside the frame, and to maintain the electrical connection between the first conductive terminal and the power supply terminal unit. Upper and lower edges of the clamping portion may limit unnecessary movement of the shelf assembly in an up and down direction. The front opening of the clamping portion may have portions close to each other, so as to limit unnecessary forward movement of the shelf assembly. The shape and structure of the cover may correspond to an end portion of the frame and the clamping portion respectively, to cover the end portion of the frame and to be accommodated in the clamping portion. When the first conductive terminal is compressed so that the shelf assembly has a tendency to move forward away from the rear wall, the portions close to each other at the front opening of the clamping portion may be combined with the cover to hold the shelf assembly in place, to limit forward movement of the shelf assembly. The mounting portion may include a support portion extending forward from one side of the opening of the clamping portion to at least partially support a corresponding side edge of the glass panel from below, to prevent the mounting portion from falling down. The two side walls may limit the side-to-side swaying of the shelf assembly and the movement along the lateral direction.

In a possible embodiment, the shelf assembly includes a light-guiding glass plate and a frame disposed along a rear edge of the glass plate, and the frame includes: a mounting groove for receiving edges of the glass plate; a mounting cavity separated from the mounting groove; the light source assembly located in the mounting cavity; and the first conductive terminal electrically connected to the light source assembly, where the first conductive terminal extends from an interior of the mounting cavity to an exterior. In this way, it can be beneficial for the shelf assembly to obtain power and emit light at the rear portion, and the light propagates along the glass panel, which contributes to an aesthetically pleasing in appearance and increases the effective space utilization.

In a possible embodiment, the light is emitted from an exposed edge of the glass plate. For example, the light may be emitted from the front edge and/or the left and right side edges of the glass plate.

In a possible embodiment, the mounting cavity is provided with a fixing groove extending along a length direction of the frame, and the light source assembly is adapted to be inserted into the fixing groove from an entrance of the fixing groove. In this way, it can be beneficial to facilitate convenient and reliable connection between the light source assembly and the frame. After combined with the frame, the cover may cover the entrance of the fixing groove to prevent unnecessary interference and damage to the light source assembly in the fixing groove. When the light source assembly needs to be removed, the cover can be first separated from the frame and then the light source assembly can be extracted from the entrance.

In a possible embodiment, the fixing groove includes a front groove wall and a rear groove wall which are oppositely disposed, and a height of the front groove wall is less than a height of the rear groove wall. In this way, it can be beneficial for the light source to protrude from the front side of the circuit substrate, reducing or eliminating the possibility of blocking the light emitted by the light source when propagating forward.

In a possible embodiment, the first conductive terminal and the light source are staggered in a vertical direction. In this way, it can be beneficial to reduce the thickness of the circuit substrate and to prevent mutual interference between the first conductive terminal and the light source.

In a possible embodiment, the first conductive terminal is higher than the light source in the vertical direction. In this way, it can be beneficial for the first conductive terminal to stagger the glass plate, and to reduce the size of the frame in the front-rear direction, and improve the effective space utilization of the shelf assembly.

In a possible embodiment, the shelf assembly includes a light-guiding glass plate and a frame disposed along a rear edge of the glass plate, where the frame includes a mounting groove for accommodating the rear edge of the glass plate and a mounting cavity spaced from the mounting groove, the mounting groove includes a horizontal upper wall, and the mounting cavity includes an inclined wall adjacent to the upper wall. In this way, it can be beneficial that the glass panel may be staggered from the mounting cavity and at least some of the structures therein, so as to avoid mutual interference.

In a possible embodiment, the shelf assembly for the refrigeration appliance may have a glass panel and a frame. The frame is mounted on at least one side of the glass plate. The frame includes a mounting cavity, a light source assembly, and a first conductive terminal. The light source assembly may be located in the mounting cavity. The light source assembly includes a circuit substrate and a light source located on the circuit substrate.

The first conductive terminal includes a first end located outside the frame and a second end located in the mounting cavity to be electrically connected to the circuit substrate. In this way, it can be beneficial for the shelf assembly to obtain power through the first conductive terminal, to supply power to the light source assembly for the light source to emit light.

In a possible embodiment, the shelf assembly includes a second conductive terminal located on the circuit substrate, and the first conductive terminal is electrically connected to the second conductive terminal. In this way, it can be beneficial to facilitate convenient and reliable electrical connection between the first conductive terminal and the circuit substrate.

In a possible embodiment, the first conductive terminal and the second conductive terminal are plugged and connected along a direction perpendicular to the circuit substrate. In this way, it can be beneficial to save the space on the circuit substrate and improve the effective space utilization of the frame.

In a possible embodiment, the second conductive terminal is located on a first side of the circuit substrate away from the rear wall, and the first conductive terminal is connected to the second conductive terminal through the circuit substrate. In this way, it can be beneficial to reduce the space occupied at the rear portion of the circuit substrate by the frame.

In a possible embodiment, the shelf assembly includes a retaining wall located between the second conductive terminal and the light source along the vertical direction. In this way, it can be beneficial to reduce unnecessary diffusion and leakage of light emitted by the light source.

In a possible embodiment, the second conductive terminal includes a mounting portion mounted on the circuit substrate and a holding portion configured to be inserted with the first conductive terminal, and at least one side wall of the holding portion is elastic. In this way, it can be beneficial to facilitate convenient and reliable connection between the first conductive terminal and the second conductive terminal.

In a possible embodiment, the frame includes a first through hole, the first conductive terminal enters the mounting cavity through the first through hole, and the circuit substrate has a second conductive terminal corresponding to the first through hole. In this way, it can be beneficial that the first conductive terminal is partially located outside the frame and partially connected to the second conductive terminal in the frame.

In some cases, the projection of the second conductive terminal and the first through hole on the circuit substrate may at least partially overlap.

In a possible embodiment, the circuit substrate has a second through hole corresponding to the first through hole, and the projection of the first through hole on the circuit substrate is at least partially located in the second through hole.

In a possible embodiment, the shelf assembly includes a second conductive terminal connected to the circuit substrate, the second conductive terminal is mounted on a second side of the circuit substrate facing the rear wall, and the first conductive terminal is electrically connected to the second conductive terminal. In this way, it can be beneficial for the second conductive terminal and the light source to be located on two sides of the circuit substrate, reducing and eliminating the possibility of mutual interference.

In a possible embodiment, the first end is adapted to move relative to the frame, and the second end is immovably located in the mounting cavity. In this way, it can be beneficial for a margin for the external connection of the first conductive terminal, to improve the reliability and convenience of the connection, and to prevent the connection from being impossible or poorly connected due to errors in size, position and the like.

In a possible embodiment, the first conductive terminal includes an elastic member located between the first end and the second end. In this way, it can be beneficial that the first end moves relative to the second end.

In a possible embodiment, the first conductive terminal includes a terminal base and a terminal head movable relative to the terminal base. In this way, it can be beneficial for a margin for the external connection of the first conductive terminal, to improve the reliability and convenience of the connection, and to prevent the connection from being impossible or poorly connected due to the size error.

In a possible embodiment, the terminal base is fixed on the frame and includes a second end. In this way, it can be beneficial for fixing of the first conductive terminal.

In a possible embodiment, the terminal head is adapted to move in a direction perpendicular to the circuit substrate, and/or, the terminal base is perpendicular to the circuit substrate located in the mounting cavity. In this way, it can be beneficial to save the space on the circuit substrate and improve the effective space utilization of the frame.

In a possible embodiment, the first conductive terminal includes an elastic member located between the terminal base and the terminal head, and the elastic member is adapted to apply a force away from the light source assembly to the terminal head. In this way, it can facilitate reliability of an external connection of the terminal head. The elastic member may be in a compressed state or a stretched state, so that its corresponding resilient force may provide a force away from the light source assembly to the terminal head.

In a possible embodiment, the terminal base is in the shape of a hollow tube, and the terminal head is inserted into the terminal base and adapted to move along the terminal base. In this way, it can be beneficial to control the length and width of the first conductive terminal, and the movement trajectory of the terminal head.

In a possible embodiment, the shelf assembly includes a second conductive terminal disposed on the circuit substrate, and the terminal base is electrically connected to the second conductive terminal. In this way, it can be beneficial to facilitate the connection between the first conductive terminal and the circuit substrate through the second conductive terminal.

In a possible embodiment, at least one of the first end and the second end of the first conductive terminal is perpendicular to the circuit substrate. In this way, it can be beneficial to save the space on the circuit substrate and improve the effective space utilization of the frame.

In a possible embodiment, the first conductive terminal is mounted on an insulator, and the insulator is immovably fixed to the frame. In this way, it can be beneficial for fixing and mounting of the first conductive terminal. The insulator can be fixed to the frame by ultrasonic welding.

In a possible embodiment, the insulator is fixed on an outer surface of the frame and located outside of the frame, and the first conductive terminal extends into the mounting cavity through the insulator and the frame. In this way, it can be beneficial for both the frame and the insulator to provide support for the first conductive terminal.

In a possible embodiment, the mounting cavity is provided with a fixing groove extending along a length direction of the frame, and the light source assembly is adapted to be inserted into the fixing groove from an entrance of the fixing groove. In this way, it can be beneficial for convenient and reliable mounting of the light source assembly.

In a possible embodiment, the fixing groove includes a front groove wall and a rear groove wall which are oppositely disposed, a height of the front groove wall is less than a height of the rear groove wall, the circuit substrate includes an error-proof protrusion having a height greater than that of the front groove wall and less than that of the rear groove wall. In this way, it can be beneficial to mount the circuit substrate in the direction of the light source toward the glass panel, and to prevent misdirection during mounting of the circuit substrate.

In a possible embodiment, the first conductive terminal and the light source are staggered in the vertical direction. In this way, it can be beneficial to reduce or eliminate the possibility of mutual interference between the first conductive terminal and the light source, and reduce the thickness of the circuit substrate.

In a possible embodiment, the first conductive terminal is higher than the light source in the vertical direction. In this way, it can be beneficial to reduce or eliminate the possibility of damage to the first conductive terminal in the process of mounting the shelf assembly.

In a possible embodiment, the frame includes a mounting groove separated from the mounting cavity and for receiving edges of the glass panel, the light source faces the mounting groove, and in the vertical direction, the second end is located above the light source. In this way, it can be beneficial for the light emitted by the light source to propagate to the glass panel, and the mounting groove and the first conductive terminal are staggered up and down.

In a possible embodiment, the frame includes a mounting groove for receiving the edges of the glass panel and a light-transmitting portion separating the mounting cavity and the mounting groove. The light source faces the light-transmitting portion, and main bodies of the light-transmitting portion and the frame are made of different materials. Except for the light-transmitting portion, the rest of the frame may be made of a lightproof material. In this way, it can be beneficial for the propagation of all or most of the light emitted by the light source in the direction of the glass panel. The light-transmitting portion may be made of a material that facilitates light diffusion to improve the uniformity of the light entering the glass panel. For example, the light-transmitting portion may be made of a translucent acrylonitrile-butadiene-styrene copolymer (ABS) plastic. The main body of the frame may be made of a lightproof hard plastic. The light-transmitting portion and the main body of the frame may be formed by a co-extrusion process, so as to enhance the connection strength of the light-transmitting portion and the main body of the frame. The light-transmitting portion may be a wall shared by the mounting groove and the mounting cavity. The main body of the frame may be a mounting groove and other component parts of the mounting cavity other than the light-transmitting portion.

In a possible embodiment, a method for making the shelf assembly includes:

providing a frame, where the frame includes a mounting cavity and a first through hole located between two ends of the frame, the mounting cavity extends along a length direction of the frame and has at least one entrance located at least one of the two ends of the frame, and the first through hole is in communication with the mounting cavity;

inserting a light source assembly into the mounting cavity through an entrance, where the light source assembly includes a circuit substrate and a light source located on the circuit substrate; and inserting a first conductive terminal into the mounting cavity through the first through hole to come into contact with the second conductive terminal located on the circuit substrate.

In this way, it can be beneficial to mount the first conductive terminal in contact with the second conductive terminal between the two ends of the frame to establish a reliable connection with the power supply terminal unit. Further, in contrast to the prior art where the frame needs to be formed by assembling a plurality of parts in order to mount the circuit substrate and the first conductive terminal, the manufacturing method makes it possible to reduce the quantity of the parts of the frame. For example, it becomes possible for the frame to be a single member. The frame, especially an upper surface of the frame, may be of a seamless structure, and the possibility of liquid or mist entering the mounting cavity to contaminate the electrical member and/or the light-transmitting portion may be significantly reduced.

In a possible embodiment, the refrigeration appliance includes a storage compartment and the shelf assembly mounted in the storage compartment. In this way, it can be beneficial for the shelf assembly to obtain power from the storage compartment, to emit light within the storage compartment and the like.

In a possible embodiment, the first conductive terminal protrudes toward the rear wall of the storage compartment. In this way, it can be beneficial for the first conductive terminal to obtain power from the rear wall, and a user is less likely to reach and see the first conductive terminal when the shelf assembly is located in the storage compartment, providing a better experience.

In a possible embodiment, the shelf assembly used for the refrigeration appliance includes a frame, a first conductive terminal, and a light source assembly. The first conductive terminal includes a first end located outside the frame and a second end located in the frame. The light source assembly may include a circuit substrate at least partially located in the frame and a second conductive terminal mounted on the circuit substrate. The second conductive terminal is in contact with the second end. In this way, it can be beneficial for the shelf assembly to obtain power through the first conductive terminal, to supply power to the light source assembly.

In a possible embodiment, the frame includes a first through hole, the circuit substrate has a second through hole corresponding to the first through hole, the second conductive terminal includes a holding portion corresponding to the first through hole and the second through hole, and the first conductive terminal is in contact with the holding portion through the first through hole and the second through hole. In this way, by making the first conductive terminal and the second conductive terminal in contact, a cable connection between the first conductive terminal and the second conductive terminal is no longer required, which can effectively reduce the need to use cables in the frame, thereby increasing manufacturing efficiency. In addition, receiving the first conductive terminal by the holding portion makes a plurality of contacts formed between the two, which can be beneficial to ensure reliability and stability of the power obtained by the light source.

In a possible embodiment, the second conductive terminal includes a holding portion surrounding the second end. In this way, it can be beneficial to facilitate convenient and reliable connection between the second conductive terminal and the first conductive terminal.

In a possible embodiment, the second conductive terminal includes a mounting portion mounted on the circuit substrate, and the mounting portion extends vertically outward from one end of the holding portion. In this way, it can be beneficial for mounting and fixing of the second conductive terminal to the circuit substrate. The holding portion may be approximately perpendicular to the circuit substrate. The mounting portion may be approximately sheet-shaped.

In a possible embodiment, the holding portion includes at least one side wall that is elastic, and the at least one side wall is in contact with the second end. In this way, it can be beneficial to improve reliable connection between the first conductive terminal and the second conductive terminal. The elasticity of at least one of the side walls can be beneficial to reduce or eliminate the possibility that the first conductive terminal may not be connected, or may be poorly connected, to the second conductive terminal due to tolerances in size, location and the like.

In a possible embodiment, the quantity of at least one side wall is more than two, and at least two side walls have different heights. In this way, it can be beneficial to improve reliable connection between the first conductive terminal and the second conductive terminal. Two or more side walls having different heights can be in multi-dimensional contact with the first conductive terminal, which can be beneficial to reduce or eliminate the possibility that the first conductive terminal may not be connected, or may be poorly connected, to the second conductive terminal due to tolerances in size, location and the like.

In a possible embodiment, one end of the at least one side wall extends close to each other. In this way, it can be beneficial to improve reliable connection between the first conductive terminal and the second conductive terminal. At least one of the side wall with one end extending close to each other can be beneficial to increase the possibility of being in contact with the first conductive terminal, the gripping force and the like.

In a possible embodiment, the second conductive terminal includes a mounting portion extending outward in two opposite directions from ends of the two longer walls in the at least one side wall, and an extending portion extending outward in two opposite directions from opposite ends of the two longer walls, and the distance between the ends of the two longer walls connected to the mounting portion is greater than the distance between the opposite ends of the two longer walls connected to the extending portion. In this way, it can be beneficial that the first conductive terminal may enter from the ends of the two longer walls that are more distant and be clamped by the ends of the two longer walls that are less distant. The two longer walls and the extending portion can contribute to the elastic and reliable contact of the second conductive terminal with the first conductive terminal. The mounting portion may be fixed on the circuit substrate to mount the second conductive terminals. The two longer walls may be opposite to each other. The two longer walls may extend for a greater length relative to the circuit substrate than that of the other walls of the second conductive terminal relative to the circuit substrate. The extending portion may be a free end of the corresponding longer wall. The extending portion may have the same shape and size as the mounting portion, each being approximately sheet-shaped.

In a possible embodiment, the at least one side wall includes two shorter walls connecting the two longer walls, and ends of the two shorter walls extend close to each other. In this way, it can be beneficial for multi-dimensional contact between the first conductive terminal and the second conductive terminal, and the ends of the two shorter walls extending close to each other may provide some gripping force to the first conductive terminal. The lengths of the two longer walls may be the same. The lengths of the two shorter walls may be the same. The lengths of the two longer walls may be greater than the lengths of the two shorter walls. The two longer walls and the two shorter walls may each be approximately sheet-shaped. The four may surround at least a portion of, for example, the second end of the first conductive terminal in multidimensional and separated contact, and each applies an elastic gripping force on at least a portion of, for example, the second end of the first conductive terminal at the ends extending close to each other. For example, the two longer walls and the two shorter walls may surround at least a portion of, for example, the second end of the first conductive terminal, and may be in contact with the first conductive terminal in four directions. The two longer walls and the two shorter walls may apply an elastic gripping force at two different lengths of the first conductive terminal.

In a possible embodiment, the second conductive terminal includes a mounting portion extending in two opposite directions from one end of the holding portion and an extending portion extending in two opposite directions from the other end of the holding portion, and the extending portion and the mounting portion extend in the same direction. In this way, it can be beneficial to enhance the stability of the second conductive terminal located on the circuit substrate and improve the effective utilization of the circuit substrate. Each extending portion and the corresponding mounting portion may be in the same shape, size or be similar sheet-shaped, may extend from two opposite ends of a longer wall in a direction away from the holding portion, and may be parallel to each other and parallel to the circuit substrate.

In a possible embodiment, the shelf assembly includes a glass panel that fits into the frame on at least one side, the light source assembly includes a light source mounted on the circuit substrate, and the second conductive terminal and the light source are staggered in the vertical direction. In this way, it can be beneficial for the shelf assembly to emit light by means of the light source, and to reduce and eliminate the possibility of mutual interference between the second conductive terminal and the light source, and reduce the thickness of the circuit substrate.

In a possible embodiment, the second conductive terminal is higher than the light source in the vertical direction. In this way, it can be beneficial for smooth mounting of the shelf assembly.

In a possible embodiment, the first conductive terminal and/or the second conductive terminal are at least partially higher than a lower surface of the glass panel. In a possible embodiment, the first conductive terminal and/or the second conductive terminal are at least partially higher than an upper surface of the glass panel. In this way, the first conductive terminal and/or the second conductive terminal and the glass panel are at least partially staggered, so that the freedom of selecting the position of the light source relative to the glass panel can be increased and it can be beneficial to reduce the impact of the first conductive terminal and/or the second conductive terminal on the light into the glass panel. For example, a retaining wall may be arranged between the first conductive terminal and/or the second conductive terminal and the light source, to block the light into the region where the first conductive terminal and/or the second conductive terminal is located.

In a possible embodiment, the refrigeration appliance includes a storage compartment and the shelf assembly mounted in the storage compartment. In this way, it can be beneficial that the refrigeration appliance may supply power to the shelf assembly, and the shelf assembly may glow in the storage compartment.

In a possible embodiment, the circuit substrate extends parallel to the rear wall of the storage compartment. In this way, it can be beneficial to reduce the size of the frame, and improve the effective space utilization of the shelf assembly and the storage compartment.

In a possible embodiment, the refrigeration appliance includes a storage compartment, an inner wall, and a power supply terminal unit. The inner wall faces the storage compartment. The power supply terminal unit includes a conductive terminal and an insulating housing connected to the inner wall. The conductive terminal includes a first connection portion that at least partially covers the insulating housing to be exposed in the storage compartment, and a second connection portion that at least partially extends beyond the storage compartment. The second connection portion is connected to the first connection portion. In this way, it can be beneficial for the refrigeration appliance to supply power to a power-demanding device such as the shelf assembly in the storage compartment through the inner wall.

In a possible embodiment, the first connection portion extends parallel to the inner wall. In this way, it can be beneficial for the convenience of supplying power through the first connection portion. The first connection portion may be approximately sheet-shaped. The surface of the first connection portion toward the storage compartment may be approximately flush with the surface of the inner wall toward the storage compartment. In addition, even if the position of the power-demanding device relative to the storage compartment changes with the use of the refrigeration appliance, the first connection portion facing the storage compartment may still form a connection with the terminal of the power-demanding device due to the shape of the first connection portion. This is particularly beneficial when the terminal on the power-demanding device is a probe terminal.

In a possible embodiment, the second connection portion extends in a direction away from the storage compartment. In this way, it can be beneficial that the second connection occupies less or even no space in the storage compartment, increasing the effective space utilization of the storage compartment and enhancing the neatness and aesthetics of the storage compartment.

In a possible embodiment, the second connection portion is perpendicular to the first connection portion. In this way, it can be beneficial to connect the power supply terminal unit externally from mutually perpendicular directions to avoid conflicts or occupying an excessive volume in one direction. The first connection portion may be approximately a rectangular or square or circular sheet. The second connection portion may extend from a bend in one of the shorter sides of the first connection portion. The width of the second connection portion may be less than the width of the shorter side of the connected first connection portion. The second connection portion may have an approximately z-shaped cross-section, and may include a first section extending vertically from the first connection portion, a middle section extending parallel subsequently, and a final section extending vertically. The final section may be perpendicular to the first connection portion and connected to the mating connector. The mating connector may be a wire end connector (IDC). The mating connector may include a terminal electrically connected to the second connection portion.

In a possible embodiment, the insulating housing includes a mounting plate, which has an inlay portion inlaid with the first connection portion. In this way, it can be beneficial for fixing and mounting of the first connection portion. The mounting plate may be approximately a rectangular plate. The length, width, and thickness of the mounting plate may be greater than the length, width, and thickness of the first connection portion respectively. The inlay portion may be a recess in a surface of the mounting plate. The length, width, and thickness of the inlay portion may be equal to the length, width, and thickness of the first connection portion respectively. After the first connection portion is accommodated in the inlay portion, the outer surface of the first connection portion may be flush with the outer surface of the surrounding mounting plate. The insulating housing may include a through hole in communication with the inlay portion, to allow the second connection portion to pass through.

In a possible embodiment, the insulating housing includes a fitting portion extending out of the storage compartment from the mounting plate, and the fitting portion has a buckle portion that is bonded to the inner wall. In this way, it can be beneficial for fixing and mounting of the insulating housing and the inner wall. The length and width of the fitting portion may be less than the length and width of the mounting plate. The thickness of the fitting portion may be greater than the thickness of the mounting plate.

In a possible embodiment, the inner wall includes an opening for mounting the power supply terminal unit and a protrusion extending into the opening, and the protrusion fits with a buckle. In this way, it can be beneficial for fixing and mounting of the power supply terminal unit and the inner wall. There may be a pair of protrusions, which are located at opposite edges of the opening in a length direction. The buckle portion may be arranged corresponding to the protrusion. The buckle portion may have some inclination and elasticity, and may spring back after penetrating from the storage compartment to the opposite side of the inner wall through the opening, and abut against the protrusion and the corresponding edge of the opening, so that the inner wall may be clamped between the mounting plate and the buckle portion, to prevent the power supply terminal unit from falling off from the inner wall.

In a possible embodiment, the inner wall includes an opening for mounting the power supply terminal unit, and a water retaining rib arranged apart from the opening. In this way, it can be beneficial to avoid the impact such as a short circuit caused by water and other solutions on the power supply terminal unit. The water retaining rib may be adjacent to one side of the edge of the opening, may protrude from the side of the inner wall that is away from the storage compartment, and may be similar to an arc-shaped sheet-shaped shed. The water retaining rib may be located above the opening.

In a possible embodiment, the inner wall includes an opening for mounting the power supply terminal unit and a limiting portion extending into the opening. In this way, it can be beneficial for fixing and mounting of the power supply terminal unit and the inner wall. The limiting portion may project from the edge of the opening and may be in contact with, for example, the fitting portion of the power supply terminal unit, and can contribute to enhancing the bonding force of the power supply terminal unit to the inner wall.

In a possible embodiment, the inner wall includes an opening for mounting the power supply terminal unit, one of the opening and the power supply terminal unit includes an error-proof rib, and the other includes an error-proof groove matched with the error-proof rib. In this way, it can be beneficial for correct mounting of the power supply terminal unit, to prevent wrong mounting and reverse mounting, so that the corresponding wire harness of the mating connector has the correct outlet direction, such as a downward direction.

In a possible embodiment, the inner wall includes an opening for mounting the power supply terminal unit, and a line card arranged apart from the opening. In this way, for example, it can be beneficial for the wire harness connected to the power supply terminal unit to be sorted and limited by the line card. The line card may be located at the lower and side part of the opening. The mating connector connected to the power supply terminal unit may be a wire end connector whose wire harness (not shown) may be sorted and limited by the line card.

In a possible embodiment, the refrigeration appliance includes an air duct cover, the inner wall is located on the air duct cover, and the second connection portion extends to a rear portion of the air duct cover through the insulating housing. In this way, it can be beneficial to mount the power supply terminal unit on the air duct cover, and reduce or eliminate the possibility and necessity of mold and process changes for larger components such as the liner of the refrigeration appliance.

In a possible embodiment, the insulating housing includes a plug portion fixed on the second connection portion to be plugged with the mating connector. In this way, it can be beneficial to facilitate reliable connection between the power supply terminal unit and the mating connector. The plug portion may be in the form of an approximate plate corresponding to the second connection portion, may be in contact with the second connection portion on one side, and may support the second connection portion.

In a possible embodiment, the refrigeration appliance includes a power-demanding device adapted to move relative to the storage compartment or removable from the storage compartment, the power-demanding device includes a first conductive terminal in the form of a probe, the first connection portion is sheep-shaped, and the first conductive terminal abuts against the first connection portion. In this way, it can be beneficial for the refrigeration appliance to supply power to the power-demanding device in a simple and reliable way, and the inner wall can be flat and have a better appearance. The inner wall may be one or more of the rear wall, the side wall, the top wall, and the bottom wall of the storage compartment. One example of the power-demanding device may be the shelf assembly.

In a possible embodiment, the refrigeration appliance includes a protective sheet that removably covers the first connection portion. In this way, it can be beneficial to reduce the possibility of scratches, abrasions, and damage on the first connection portion during the manufacturing, transportation, and storage of the refrigeration appliance.

The protective sheet may correspond to the size and shape of the first connection portion, to at least partially cover the first connection portion. The protective sheet and the first connection portion may be combined by adhesion or the like. In a possible embodiment, the protective sheet includes a removal portion. In this way, the protective sheet can be separated from the first connection portion by means of the removal portion. The removal portion may be a protruding portion of an edge of the protective sheet. The removal portion may not be combined with the first connection portion.

In a possible embodiment, the refrigeration appliance includes a power-demanding device adapted to move relative to the storage compartment or removable from the storage compartment, the power-demanding device includes a first conductive terminal, and the protective sheet is located between the first conductive terminal and the power supply terminal unit and electrically connects the first conductive terminal and the power supply terminal unit. In this way, it can be beneficial to detect the performance of the refrigeration appliance in supplying power to the power-demanding device, for example, without removing the protective sheet in the process of manufacturing the refrigeration appliance, and to reduce and eliminate the impact on the manufacturing process of the refrigeration appliance. One example of the power-demanding device may be the shelf assembly.

In a possible embodiment, the thickness of the protective sheet ranges from 0.1 mm to 1 mm. In this way, it can be beneficial to, on one hand, ensure reliability and prevent the protective sheet from being worn out, and one the other hand, prevent excessive compression of the connection space of the first conductive terminal and the power supply terminal unit, for example, excessive compression of the terminal head and the elastic member of the first conductive terminal, which generates a hard collision and damages the first conductive terminal and the power supply terminal unit. The values in this application may include values within the error range of measurements, metrology, and the like. The error range may be plus or minus five percent. 1 mm may include 0.95 mm, 0.97 mm, 1 mm, 1.02 mm, 1.05 mm, and the like. The range of values in this application may include any subrange thereof. For example, 0.2 mm to 1 mm may include 0.2 mm to 0.3 mm, 0.4 mm to 0.8 mm, 0.5 mm to 0.9 mm, 0.6 mm to 1 mm, and so on.

In a possible embodiment, the refrigeration appliance includes a guard member removably disposed on the inner wall, and the guard member and the power supply terminal unit are spaced apart. In this way, it can be beneficial to limit the relative position between the first conductive terminal and the power supply terminal unit, and to optimize the stability of the connection between the first conductive terminal and the power supply terminal unit.

In a possible embodiment, the refrigeration appliance includes a shelf assembly, the guard member includes a gripping portion clamped between the shelf assembly and the inner wall, and a thickness T is greater than a gap between the shelf assembly and the inner wall. In this way, it can facilitate an interference fit to eliminate design and assembly gaps and to prevent shaking from causing strike and abrasions to the connection between the shelf assembly and the inner wall, and the connection between the first conductive terminal and the power supply terminal unit.

In a possible embodiment, the guard member includes a bent portion bent from ends of the gripping portion and extending toward the shelf assembly, and the bent portion is in contact with the first contact surface and the second contact surface of the shelf assembly that are opposite to each other. In this way, it can be beneficial to limit the movement of the shelf assembly back and forth in a direction parallel to the inner wall.

In a possible embodiment, the refrigeration appliance includes a removal tip zone. In this way, it can be beneficial to remove the protective sheet and/or the guard member according to hints of the removal tip zone when needed, for example, when the user starts using the refrigeration appliance. The removal tip zone may be arranged in a location visible to the user, such as an unshaded part of the inner wall.

In a possible embodiment, there are a plurality of power supply terminal units, which are arranged separately. In this way, it can be beneficial for the refrigeration appliance to be powered at a plurality of separated positions, improving the flexibility and convenience of power supply.

In a possible embodiment, the refrigeration appliance includes a storage compartment and a shelf assembly. The shelf assembly is mounted on the storage compartment. The shelf assembly includes a glass panel, a frame, and a first conductive terminal. The glass panel is provided with a central surface. The frame is arranged on at least one side of the glass panel. The first conductive terminal is arranged on the frame and includes a first end extending out of the frame. The first end is adapted to move along an axis in a direction away from or close to the glass panel. The axis and the central surface are staggered with each other in a vertical direction. In this way, it can be beneficial to reduce or eliminate the possibility of mutual interference between the glass panel and the first conductive terminal, to control the size of the shelf assembly in the horizontal direction, and to facilitate the mounting of the shelf assembly.

In a possible embodiment, the axis is higher than the central surface in the vertical direction. In this way, it can be beneficial for mounting of the shelf assembly.

In a possible embodiment, the glass panel includes an upper surface, which is lower than the axis in the vertical direction. In this way, it can be beneficial to reduce or eliminate the possibility of mutual interference between the glass panel and the first conductive terminal, to control the size of the shelf assembly in the horizontal direction, and to facilitate the mounting of the shelf assembly.

In a possible embodiment, the shelf assembly includes a retaining wall that is higher than the central surface in the vertical direction. In this way, it can be beneficial for convenient processing and manufacturing of the shelf assembly.

In a possible embodiment, the shelf assembly includes a retaining wall that is lower than the axis in the vertical direction. In this way, it can be beneficial to reduce or eliminate the possibility of mutual interference between the first conductive terminal and the retaining wall, to control the size of the shelf assembly in the horizontal direction. The retaining wall may extend toward the first conductive terminal.

In a possible embodiment, the shelf assembly includes a light source, and has a projection in the vertical direction within the thickness range of the glass panel. In this way, it can be beneficial for the propagation of all or most of the light emitted by the light source in the direction of the glass panel.

In a possible embodiment, the shelf assembly includes a circuit substrate and a light source disposed on the circuit substrate. The first conductive terminal includes a second end connected to the circuit substrate, and the second end and the light source are staggered from each other in the vertical direction. In this way, it can be beneficial for the first conductive terminal to supply power to the light source through the circuit substrate, and the circuit substrate is less thick, and it is less likely that the first conductive terminal interferes with the light source.

In a possible embodiment, the shelf assembly includes a circuit substrate having a height in the vertical direction that is greater than the thickness of the glass panel in the vertical direction. In this way, for example, the second conductive terminals, the first conductive terminals, and the glass panel that are mounted and connected on the circuit substrate are staggered from each other in the vertical direction. In a possible embodiment, the glass panel and the first conductive terminal are arranged apart from the frame. In this way, it can be beneficial for the reliable structure of the frame, reducing or eliminating the possibility of mutual interference of the frame on the glass panel and the first conductive terminal.

In a possible embodiment, the frame includes: a mounting groove for receiving edges of the glass panel, and a mounting cavity for mounting the first conductive terminal. A maximum height of the mounting cavity in the vertical direction is greater than a maximum height of the mounting groove in the vertical direction. In this way, it can be beneficial that the first conductive terminal and the glass panel may be staggered in the vertical direction. The maximum height of the mounting cavity in the vertical direction may be a height between its lowest point and its highest point. The maximum height of the mounting groove in the vertical direction may be a height between its lowest point and its highest point.

In a possible embodiment, the refrigeration appliance includes a storage compartment and a shelf assembly. The shelf assembly is mounted on the storage compartment. The shelf assembly includes a glass panel, a frame, and a light source. The glass panel is provided with an upper surface and a lower surface opposite to the upper surface. The frame is mounted on at least one side of the glass panel. The light source is disposed in the frame and has a projection in the vertical direction located between the upper surface and the lower surface. In this way, it can be beneficial that all or most of the light emitted by the light source may propagate toward the glass panel, reducing the loss of light in other directions.

In a possible embodiment, the frame includes a light-transmitting portion, which is located between the light source and the glass panel. In this way, it can be beneficial for the light emitted by the light source to propagate more toward the glass panel than in other directions. The light-transmitting portion may be made of a material that facilitates light diffusion to improve the uniformity of the light entering the glass panel. For example, the light-transmitting portion may be made of a translucent acrylonitrile-butadiene-styrene copolymer (ABS) plastic. The other parts of the frame may be made of a lightproof hard plastic.

In a possible embodiment, the frame includes a retaining wall extending toward the light source from a height above the upper surface. In this way, it can be beneficial to at least partially block the light emitted by the light source, reducing or eliminating the possibility of propagation in a direction higher than the glass panel.

In a possible embodiment, the frame includes an upper wall in contact with the upper surface, an inclined wall adjacent to the upper wall, and a retaining wall extending from the joint of the upper wall and the inclined wall toward the light source. In this way, it can be beneficial for convenient processing of the frame, and the vertical misalignment of the glass panel with at least part of the structure of the frame, to control the size of the frame in the horizontal direction.

In a possible embodiment, the frame includes: a mounting groove for receiving a edges of the glass panel, a mounting cavity for mounting the light source, and a light-transmitting portion spaced between the mounting groove and the mounting cavity. In this way, it can be beneficial that there is little or no possibility of mutual interference between the light source and the glass panel, and that the light emitted by the light source tends to propagate toward the glass panel. The light-transmitting portion may be a wall shared by the mounting groove and the mounting cavity. The light diffusion performance of the light-transmitting portion may be higher than that of the rest parts of the mounting groove and the mounting cavity.

If technical conditions permit, the subject protected by any of the independent claim in this application may be combined with a single subject or a combination of subjects protected by any of the dependent claim to form a new protected subject.

This application will be further described below with reference to the brief description of drawings. The drawings may use the same, similar designations to refer to the same, similar elements, shapes, configurations, and the like in different embodiments, or may omit descriptions of the same, similar elements, shapes, configurations, effects, and the like in different embodiments, and descriptions of prior art elements, shapes, configurations, features, effects, and the like.

DETAILED DESCRIPTION

Figure 1:
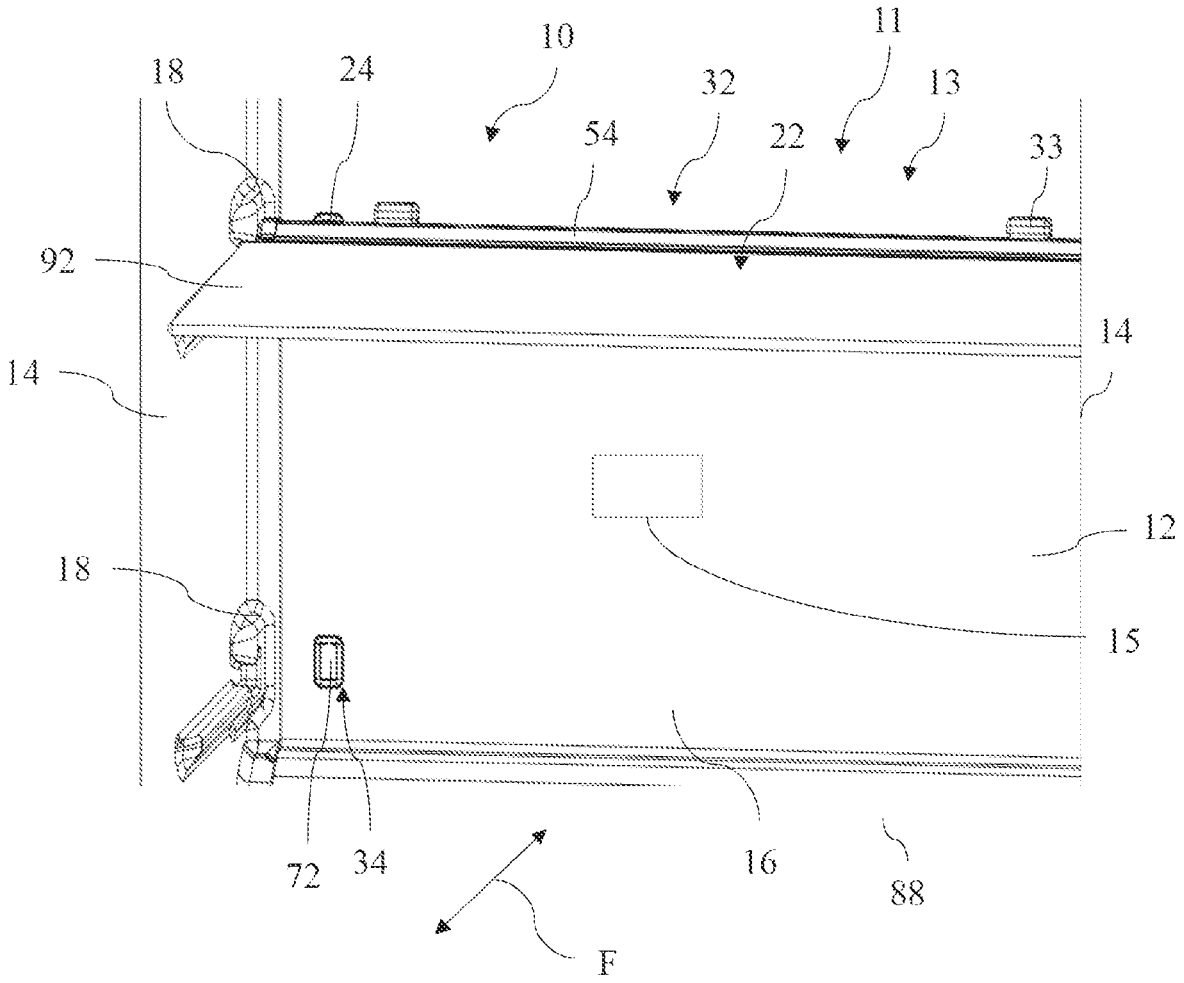
FIG. 1 is a schematic partial perspective view of a refrigeration appliance according to one aspect of embodiments of this application.

FIG. 1 is a schematic partial perspective view of a refrigeration appliance according to one aspect of the embodiments of this application. Referring to FIG. 1, in a possible embodiment, the refrigeration appliance 10 includes a storage compartment 12. The refrigeration appliance 10 may be a refrigerator. The storage compartment 12 may include a refrigerating chamber, a freezing chamber, and the like. The storage compartment 12 is provided with a pair of opposite side walls 14 and a rear wall 16 between the side walls.

The rear wall 16 may connect rear ends of the two side walls 14 to form a storage space. The storage compartment 12 may include a top wall and a bottom wall connecting the rear wall 16, the top of the side wall 14, and the bottom of the side wall 14, to define the top and bottom of the storage space respectively.

The refrigeration appliance 10 may include a box-type liner to form the side walls 14, the top wall, the bottom wall, and the rear wall 16 of the storage compartment 12. The refrigeration appliance 10 may include an air duct cover disposed in the liner along the rear and/or an upper portion of the liner, to form an air duct 58 for fluid communication with the storage compartment 12. Therefore, in embodiment, the rear wall 16 may include the air duct cover 60.

For the terms "side", "rear", "top", "bottom", "front", "upper", "lower", "left", "right", "lateral", "vertical", "horizontal" and the like in this specification, reference may be made to the orientation and relationship shown in the drawings, and the terms may also correspond to the orientation and relationship relative to the user when the refrigeration appliance 10 is used.

The refrigeration appliance 10 includes a shelf assembly 22. Each side wall 14 is provided with a mounting portion 18. The shelf assembly 22 is mounted on a storage compartment 12 by the mounting portion 18. The movement of the shelf assembly 22 in a front-rear direction F along the storage compartment 12 is limited by the mounting portion 18. The mounting portion 18 may be integrally formed in the liner or include a support structure mounted in the liner.

The shelf assembly 22 includes at least two first conductive terminals 24. The first conductive terminal 24 is located at a rear portion of the shelf assembly 22. There may be a plurality of shelf assemblies 22. Each shelf assembly 22 may correspond to the mounting portions 18 of the two side walls 14. Each shelf assembly 22 may be combined with the mounting portions 18 of the two side walls 14 on both sides. The mounting portion 18 may be located on a portion of the side wall 14 close the rear wall 16. The at least two first conductive terminals 24 may be spaced apart from each other.

The terms "first", "second" and the like in this specification are not used to denote importance, priority and the like, but are intended to distinguish the elements, shapes, configurations and the like they modify.

Figure 2:
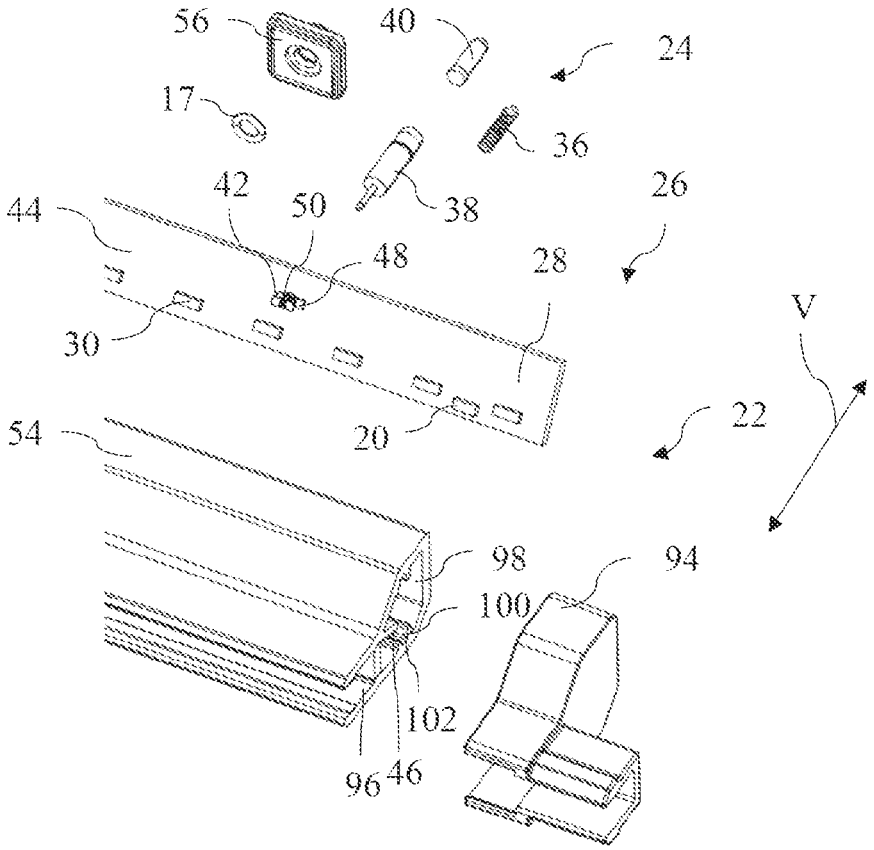
FIG. 2 is a schematic partial enlarged exploded perspective view of a shelf assembly of the refrigeration appliance in FIG. 1.

FIG. 2 is a schematic partial exploded perspective view of a shelf assembly of the refrigeration appliance in FIG. 1. As shown in FIG. 2, the refrigeration appliance 10 includes a light source assembly 26. The light source assembly 26 includes a circuit substrate 28 and a light source 30 located on the circuit substrate 28. The light source assembly 26 is disposed on the shelf assembly 22. The light source 30 may include a light emitting diode.

There may be a plurality of light sources 30, which may be arranged in a row on the circuit substrate 28 at intervals. The light source assembly 26 may provide light for the shelf assembly 22 and the storage compartment 12.

Still referring to FIG. 1, the refrigeration appliance 10 includes a power supply portion 32. The power supply portion 32 is located at a rear portion of the storage compartment 12 to supply power to the light source 30 for illumination. The power supply portion 32 includes a power supply terminal unit 34 close to the corresponding side wall 14.

The power supply terminal unit 34 is disposed on the rear wall 16, and the first conductive terminal 24 maintains electrical connection to the power supply terminal unit 34 by means of the mounting portion 18. The power supply terminal unit 34 and the first conductive terminal 24 may be in the same quantity, in one-to-one correspondence, and connected respectively.

The embodiments of this application can facilitate convenient and reliable connection between the shelf assembly 22 and the storage compartment 12 and the like.

For example, the first conductive terminal 24 at the rear portion of the shelf assembly 22 is electrically connected to the power supply terminal unit 34 at the rear portion of the storage compartment 12, and the reliable electrical connection between the two is maintained by mating of the mounting portion 18 located at the side wall 14 and the shelf assembly 22, which can facilitate the connection after the shelf assembly 22 is inserted into the storage compartment 12 from the front to the rear, and the reliable connection is maintained by the limitation to the shelf assembly 22 by the mounting portion 18, which is relatively convenient. The shelf assembly 22 is electrically connected to the power supply terminal unit 34 through at least two first conductive terminals 24 respectively, which can contribute to reliability of the connection and provide some possibilities, for example, make the first conductive terminals 24 have different polarities, such as positive or negative, to reduce the possibility of liquid-like substances communicating the first conductive terminals 24 with the power supply terminal unit 34, thereby improving the safety of the refrigeration appliance 10. In addition, the movement of the shelf assembly 22 in the front-rear direction F along the storage compartment 12 is limited by the mounting portion 18, which can facilitate reliability of the connection.

Figure 3:
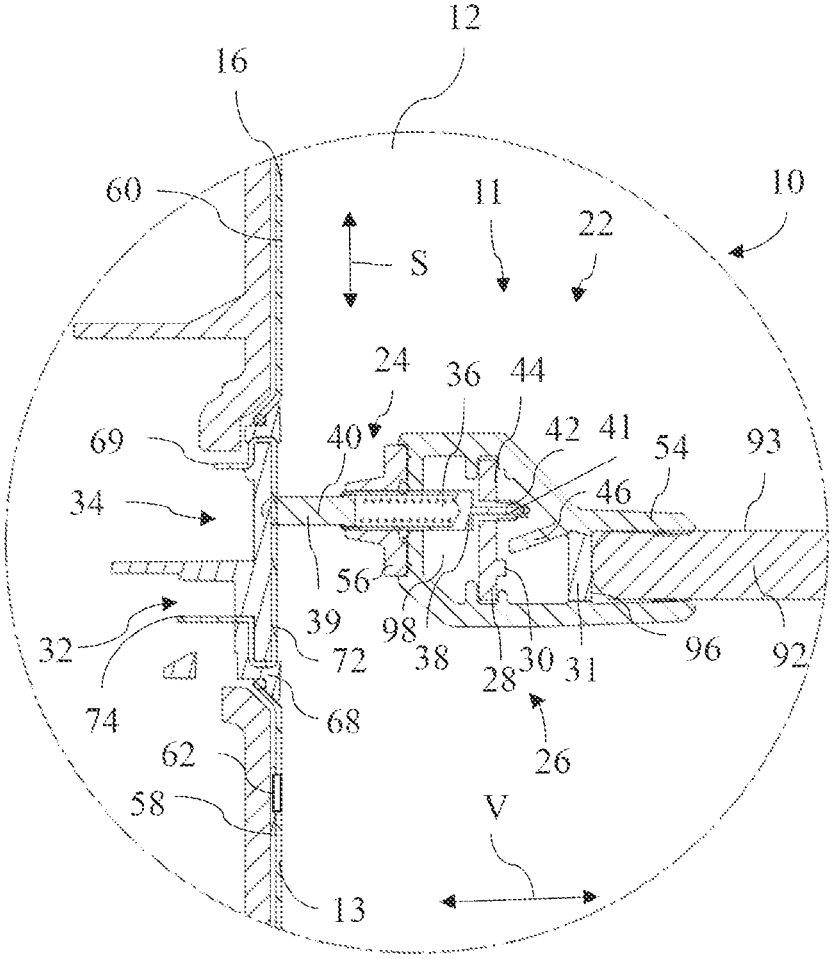
FIG. 3 is a schematic partial enlarged sectional view of the refrigeration appliance in FIG. 1.

FIG. 3 is a schematic partial enlarged sectional view of the refrigeration appliance in FIG. 1; Referring to FIG. 3, in a possible embodiment, the refrigeration appliance 10 includes an elastic member 36 located in the shelf assembly 22, the at least two first conductive terminals 24 maintain electrical connection with the corresponding power supply terminal units 34 respectively under the action of the elastic member 36.

When the shelf assembly 22 is mounted on the mounting portion 18, the elastic member 36 can apply a force toward the power supply terminal unit 34 to an end of the first conductive terminal 24. On the other hand, both sides of the shelf assembly 22 are limited by the mounting portion 18, so that reliable connection between the first conductive terminal 24 and the power supply terminal unit 34 can be maintained.

In this way, it can be beneficial to guarantee the reliability of the electrical connection between the at least two first conductive terminals 24 and the corresponding power supply terminal units 34, avoiding the inability and poor connection due to tolerances in size, position and the like.

The elastic member 36 may be a spring. The elastic member 36, the at least two first conductive terminals 24, and the corresponding power supply terminal units 34 may be in the same quantity and in one-to-one correspondence. When the shelf assembly 22 is mounted on the mounting portion 18, the elastic member 36 is compressed, so that the end of the first conductive terminal 24 abuts against the power supply terminal unit 34.

In a possible embodiment, each of the at least two first conductive terminals 24 includes the elastic member 36.

In this way, it can be beneficial to guarantee reliable connection of each of the at least two first conductive terminals 24.

In a possible embodiment, each of at least two first conductive terminals 24 includes a terminal base 38 and a terminal head 40 movable relative to the terminal base 38. In the process of mounting the shelf assembly 22 on the mounting portion 18, the terminal head 40 is compressed to move toward the terminal base 38, and after the shelf assembly 22 mounted on the mounting portion 18, the mounting portion 18 limits the movement of the shelf assembly 22 toward a front opening 88 of the storage compartment 12, whereby the terminal head 40 and the corresponding power supply terminal unit 34 may abut against each other.

In this way, it can be beneficial to guarantee the reliability of the electrical connection between the at least two first conductive terminals 24 and the corresponding power supply terminal units 34.

Specifically, the mounting portion 18 may facilitate holding the shelf assembly 22 at a position where the terminal head 40 abuts against the corresponding power supply terminal unit 34 are. The relative movement of the terminal head 40 and the terminal base 38 may help the shelf assembly 22 maintain a margin at the position where the terminal head 40 abuts against the corresponding power supply terminal unit 34.

In a possible embodiment, each of the at least two first conductive terminals 24 includes an elastic member 36 located between the terminal base 38 and the terminal head 40, the elastic member 36 is adapted to apply a force toward the corresponding power supply terminal unit 34 to the terminal head 40, so that the terminal head 40 abuts against the power supply terminal unit 34.

In this way, it can be beneficial to guarantee the reliability of the electrical connection between the at least two first conductive terminals 24 and the corresponding power supply terminal units 34.

The elastic member 36 may be in a compressed state or a stretched state, so that its corresponding resilient force provides a force for the terminal head 40 to abut against the power supply terminal unit 34.

In a possible embodiment, the terminal base 38 is in the shape of a hollow tube, and the terminal head 40 is inserted into the terminal base 38 and adapted to move along the terminal base 38.

In this way, it can be beneficial to facilitate relative movement and reliable connection between the terminal base 38 and the terminal head 40 and control the movement trajectory of the terminal head 40.

The terminal head 40 may be a cylinder with an outer diameter less than and equal to an inner diameter of the terminal base 38. The terminal head 40 may be solid.

In the process of mounting the shelf assembly 22 in the storage compartment 12, the terminal head 40 moves relative to the terminal base 38 during contact with the power supply terminal unit 34, and the position of the terminal head 40 relative to the terminal base 38 is determined by the position of the shelf assembly 22 in the storage compartment 12 when the mounting of the shelf assembly 22 is completed, thereby achieving the reliable connection between the terminal head 40 and the power supply terminal unit 34.

In a possible embodiment, the refrigeration appliance 10 includes a second conductive terminal 42 disposed on the circuit substrate 28, and the terminal base 38 is electrically connected to the second conductive terminal 42.

In this way, it can facilitate the electrical connection between the first conductive terminal 24 and the second conductive terminal 42 to supply power to the circuit substrate 28 and the light source 30.

In a possible embodiment, the first conductive terminal 24 is perpendicular to the circuit substrate 28.

In a possible embodiment, the first conductive terminal 24 may extend along the front-rear direction F, and the circuit substrate 28 is parallel to the rear wall 16 of the storage compartment 12 and/or the front opening 88 of the storage compartment 12.

In this way, it can be beneficial to establish the connection between the first conductive terminal 24 and the second conductive terminal 42 on the circuit substrate 28, and facilitate the reliability of the electrical connection between the first conductive terminal 24 and the circuit substrate 28.

In a possible embodiment, the refrigeration appliance 10 includes a second conductive terminal 42 connected to the circuit substrate 28, where the first conductive terminal 24 and the second conductive terminal 42 are plugged and connected along a direction V perpendicular to the circuit substrate 28.

In this way, the reliability of the conductive connection between the first conductive terminal 24 and the circuit substrate 28 can be further improved.

In a possible embodiment, the second conductive terminal 42 is located on a first side 44 of the circuit substrate 28 away from the rear wall 16, and the first conductive terminal 24 is connected to the second conductive terminal 42 through the circuit substrate 28.

In this way, the space occupied at a rear portion of the circuit substrate 28 by the second conductive terminal 42 can be reduced, which is beneficial to improve space utilization of the shelf assembly 22.

In a possible embodiment, the shelf assembly 22 includes a retaining wall 46 located between the second conductive terminal 42 and the light source 30 along a vertical direction S.

In this way, it can be beneficial to prevent the combination between the second conductive terminal 42 and the first conductive terminal 24 from possibly causing damage to the light source 30 and avoiding unnecessary diffusion of light emitted by the light source 30.

Figure 4:
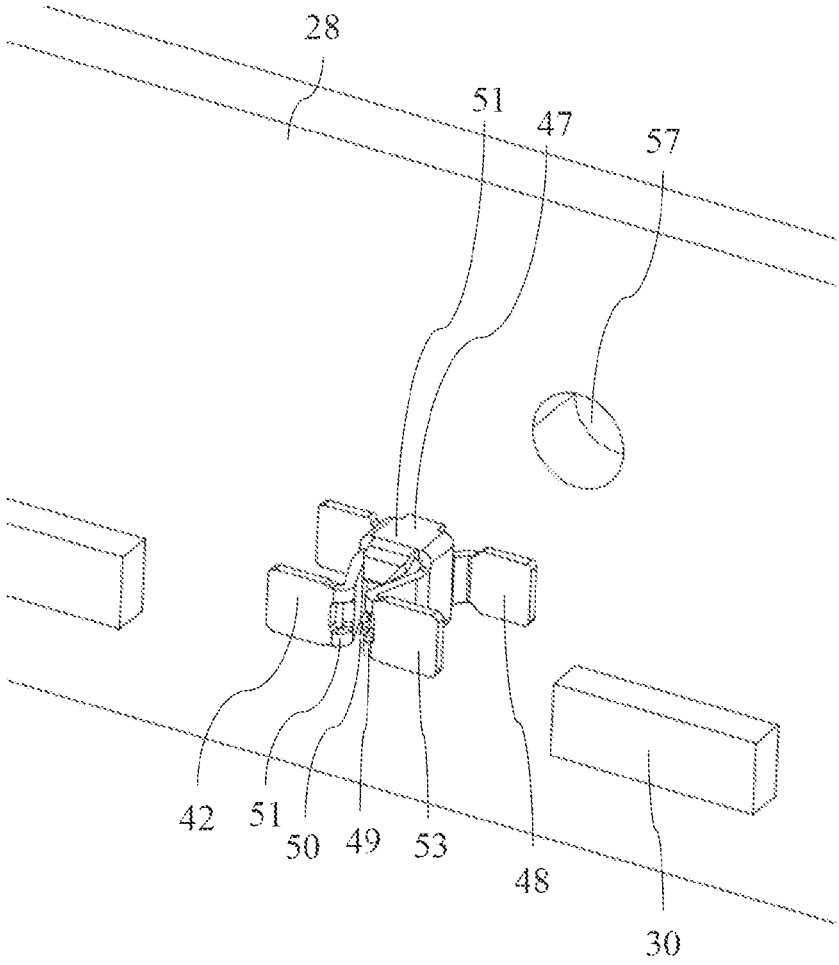
FIG. 4 is a schematic partial enlarged exploded perspective view of the refrigeration appliance in FIG. 1.

FIG. 4 is a schematic partial enlarged exploded perspective view of the refrigeration appliance in FIG. 1. As shown in FIG. 4, in a possible embodiment, the second conductive terminal 42 includes a mounting portion 48 mounted on the circuit substrate 28 and a holding portion 50 configured to be inserted with the first conductive terminal 24, and at least one side wall of the holding portion 50 is elastic.

In this way, it can be beneficial to facilitate convenient and reliable connection between the first conductive terminal 24 and the second conductive terminal 42, reduce or eliminate wobble of the first conductive terminal 24, provide a margin at a relative position of the first conductive terminal 24 and the second conductive terminal 42, and connect the first conductive terminal 24 and the circuit substrate 28 by means of the second conductive terminal 42.

The mounting portion 48 may be sheet-shaped. The holding portion 50 may at least partially surround the first conductive terminal 24.

In some other embodiments, the refrigeration appliance 10 includes a second conductive terminal 42 connected to the circuit substrate 28, the second conductive terminal 42 is mounted on a second side of the circuit substrate 28 facing the rear wall 16, and the first conductive terminal 24 is electrically connected to the second conductive terminal 42.

In this way, it can be beneficial for mounting of the second conductive terminal 42 and the light source 30 on different sides of the circuit substrate 28, so as to reduce and avoid the impact of the connection between the first conductive terminal 24 and the second conductive terminal 42 on the light source 30.

Still referring to FIG. 3, in a possible embodiment, the refrigeration appliance 10 includes a second conductive terminal 42 connected to the circuit substrate 28, where the first conductive terminal 24 and the second conductive terminal 42 are plugged and connected along a direction V perpendicular to the circuit substrate 28 on which the light source 30 is mounted.

In this way, it can be beneficial to save space on the circuit substrate 28, reduce the size of the circuit substrate 28, and increase the effective space utilization of the shelf assembly 22.

Referring to FIG. 2, in a possible embodiment, the shelf assembly 22 includes a frame 54 for accommodating the light source 30, the first conductive terminal 24 is mounted on an insulator 56, and the insulator 56 is immovably fixed to the frame 54.

In this way, it can be beneficial for fixing and mounting of the first conductive terminal 24 on the shelf assembly 22. The insulator 56 can be fixed to the frame 54 by ultrasonic welding.

A portion of the insulator 56 in contact with the frame 54 may be approximately square block-shaped. The insulator 56 may include an approximately cylindrical cylinder portion extending from the square block-shaped portion toward the rear wall 16. The insulator 56 may be provided with a through hole in the middle to allow the first conductive terminal 24 to pass through. The surface of the side of the insulator 56 close to the frame 54 may be partially recessed to accommodate a gasket 17 in contact with the first conductive terminal 24. The insulator 56 may be combined with a portion of the terminal base 38 extending from the frame 54 to provide support therefor.

In a possible embodiment, the refrigeration appliance 10 includes an air duct 58 located at the rear portion of the storage compartment 12, the rear wall 16 includes an air duct cover 60, the air duct cover 60 includes at least one vent 62 communicating the air duct 58 with the storage compartment 12, and the power supply terminal unit 34 is located on the air duct cover 60.

In this way, it can be beneficial to avoid drastically changing processing mold, production process and the like of the refrigeration appliance 10, such as the processing mold, production process and the like of the liner of the refrigeration appliance 10, so as to control the cost of the refrigeration appliance 10.

Figure 5:
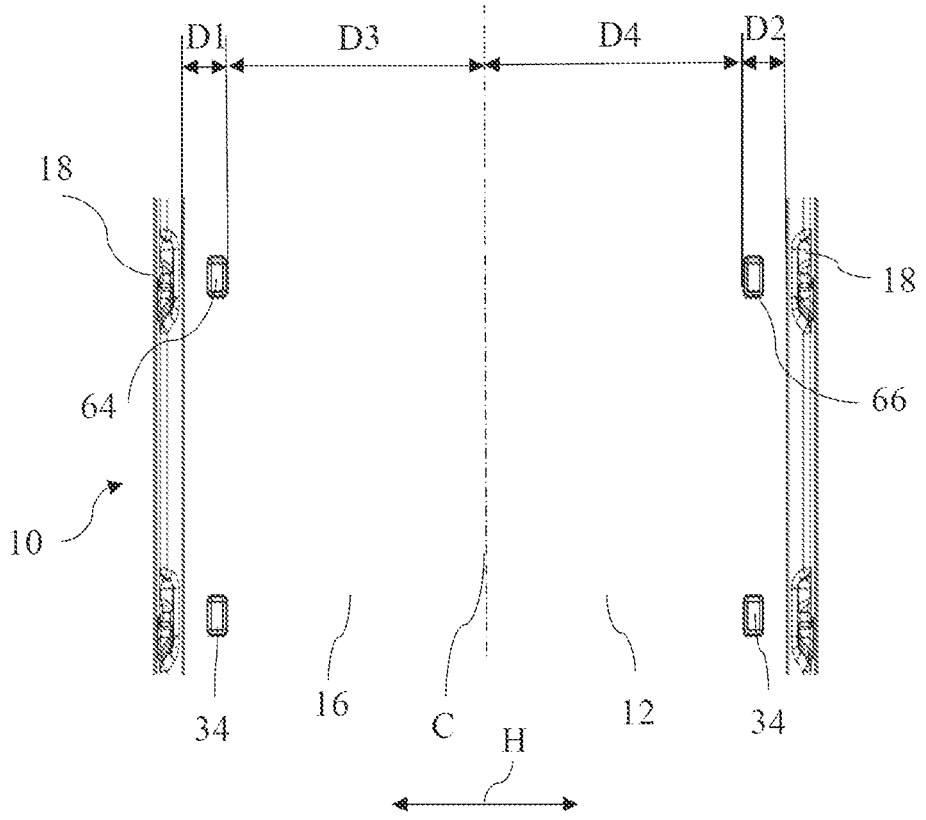
FIG. 5 is a schematic partial enlarged front view of a storage compartment of the refrigeration appliance in FIG. 1.

FIG. 5 is a schematic partial enlarged front view of a storage compartment of the refrigeration appliance in FIG. 1. As shown in FIG. 5, in a possible embodiment, the power supply terminal unit 34 includes a first power supply terminal unit 64 and a second power supply terminal unit 66, a first distance D1 between the first power supply terminal unit 64 and the corresponding mounting portion 18 in a lateral direction H of the storage compartment 12 is equal to a second distance D2 between the second power supply terminal unit 66 and the corresponding mounting portion 18 in the lateral direction H of the storage compartment 12, and the first distance D1 and the second distance D2 are respectively less than a third distance D3 between the first power supply terminal unit 64 and a lateral centerline C of the rear wall 16 and a fourth distance D4 between the second power supply terminal unit 66 and the lateral centerline C of the rear wall 16.

In this way, it can be beneficial for the shelf assembly 22 to receive uniform force when combined with the mounting portions 18 of the two side walls 14, and the combination between the shelf assembly 22 and the mounting portions 18 of the two side walls 14 can assist in maintaining the connection between the first conductive terminal 24 and the first power supply terminal unit 64 as well as the second power supply terminal unit 66.

The lateral direction H of the storage compartment 12 may be oriented from one side wall 14 to the other side wall 14.

In a possible embodiment, one of the first power supply terminal unit 64 and the second power supply terminal unit 66 is a positive electrode, and the other is a negative electrode.

In this way, it can be beneficial to keep the positive and negative electrodes separate and away from each other, to avoid short circuit of the positive and negative electrodes by, for example, solutions.

Figure 6:
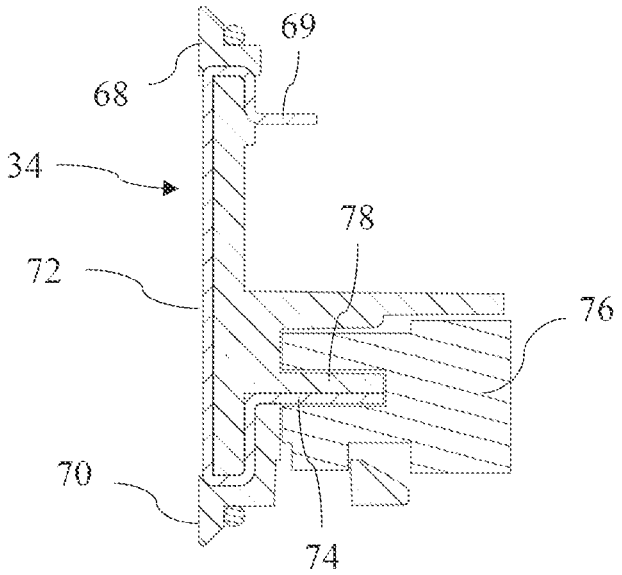
FIG. 6 is a schematic sectional view of connection between a power supply terminal unit and a mating connector of the refrigeration appliance in FIG. 1.

FIG. 6 is a schematic sectional view of connection between a power supply terminal unit and a mating connector of the refrigeration appliance in FIG. 1.

Referring to FIG. 3 and FIG. 6, in a possible embodiment, the power supply terminal unit 34 includes an insulating housing 68 connected to the rear wall 16, the insulating housing 68 includes a mounting plate 70, the power supply terminal unit 34 includes a sheet-shaped first connection portion 72 disposed along a front side of the mounting plate 70 and a second connection portion 74 located at a rear portion of the mounting plate 70, the first connection portion 72 is connected to the first conductive terminal 24, and the second connection portion 74 is connected to a mating connector 76 located in the rear wall 16.

In this way, it can be beneficial to mount and fix the power supply terminal unit 34 and the rear wall 16, the surface of the rear wall 16 toward the storage compartment 12 may be approximately flat and aesthetically pleasing in appearance, and the refrigeration appliance 10 may supply power to the light source 30 of the shelf assembly 22 through the mating connector 76 and the power supply terminal unit 34.

In a possible embodiment, the second connection portion 74 is sheet-shaped and is affixed to a plug portion 78 of the insulating housing 68, and the second connection portion 74, the plug portion 78 of the insulating housing 68, and the mating connector 76 are plugged and connected.

In this way, it can be beneficial to facilitate convenient and reliable connection between the power supply terminal unit 34 and the mating connector 76.

In a possible embodiment, the second connection portion 74 and the plug portion 78 of the insulating housing 68 extend rearward.

In this way, it can be beneficial that the second connection portion 74 and the plug portion 78 of the insulating housing 68 are at least partially located outside of the storage compartment 12, not occupying the storage space of the storage compartment 12 and increasing the effective space utilization of the storage compartment 12. In addition, the surface of the rear wall 16 toward the storage compartment 12 may be approximately flat and aesthetically pleasing in appearance.

Figure 7:
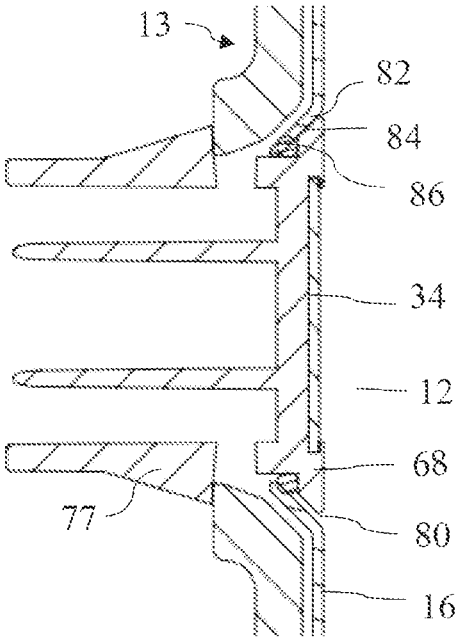
FIG. 7 is a schematic partial enlarged sectional view of the refrigeration appliance in FIG. 1.

FIG. 7 is a schematic partial enlarged sectional view of the refrigeration appliance in FIG. 1. As shown in FIG. 7, in a possible embodiment, the rear wall 16 includes an opening 80 for mounting the insulating housing 68 of the power supply terminal unit 34, the rear wall 16 includes a first bevel 82 surrounding the opening 80, the insulating housing 68 includes a second bevel 84, and the first bevel 82 and the second bevel 84 abut against each other.

In this way, it can be beneficial to facilitate convenient and reliable connection between the power supply terminal unit 34 and the rear wall 16.

In a possible embodiment, the power supply terminal unit 34 includes a sealing strip 86, and the sealing strip 86 is extruded against the first bevel 82 and/or the second bevel 84.

In this way, it can be beneficial to prevent penetration and leakage of water and other liquids.

Referring to FIG. 1, in a possible embodiment, the power supply terminal unit 34 includes a sheet-shaped first connection portion 72, which faces the front opening 88 of the storage compartment 12.

In this way, it can be beneficial to facilitate the surface of the rear wall 16 toward the storage compartment 12 may be approximately flat and aesthetically pleasing in appearance, and, it can be beneficial to connect the first conductive terminal 24 to the power supply terminal unit 34 after the shelf assembly 22 is mounted on the mounting portion 18. In addition, the shelf assembly 22 may at least partially shield the power supply terminal unit 34, avoid unintentional damage and contribute to aesthetics of the storage compartment 12.

Figure 8:
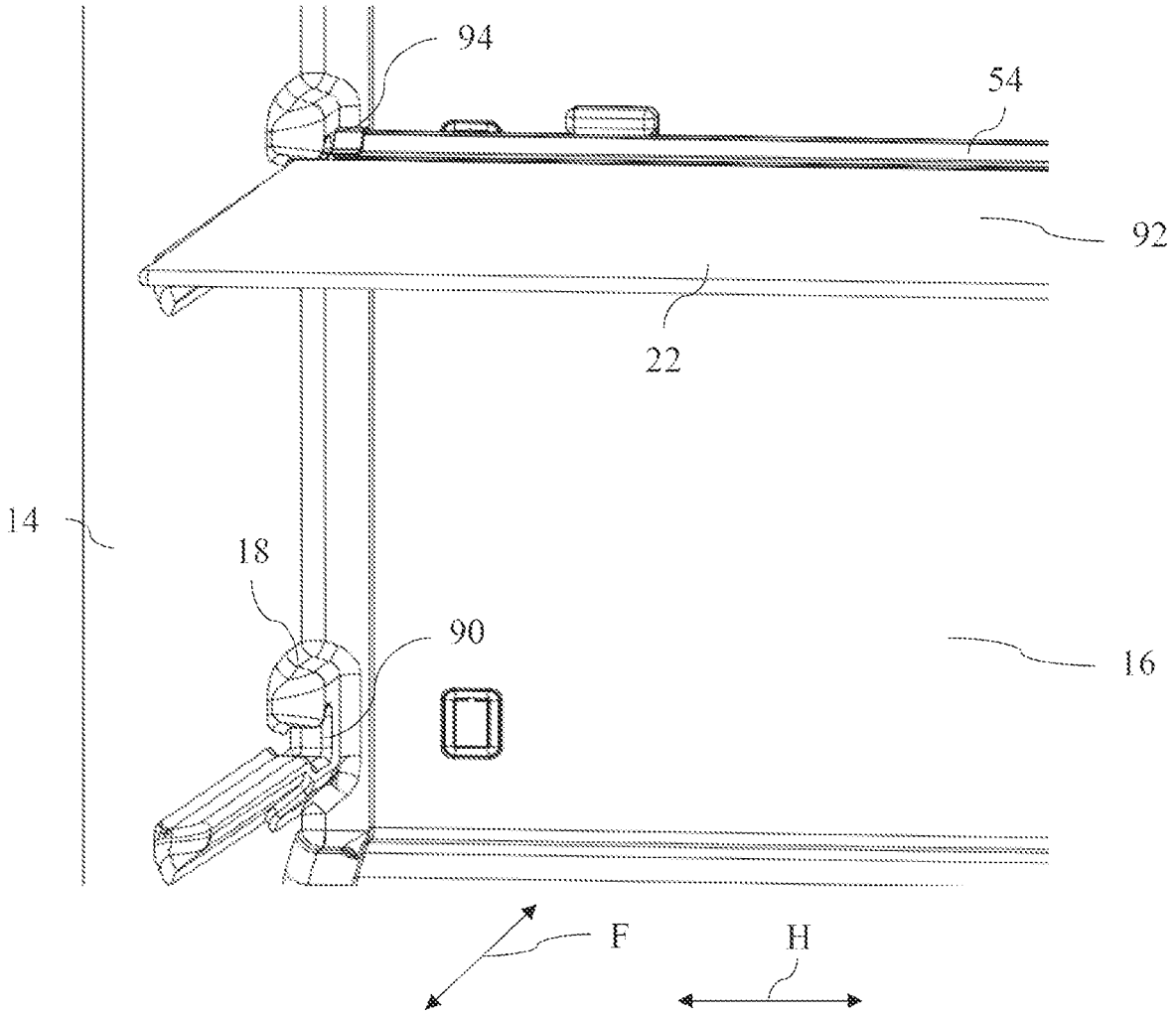
FIG. 8 is another schematic partial perspective view of the refrigeration appliance in FIG. 1.

FIG. 8 is another schematic partial perspective view of the refrigeration appliance in FIG. 1. Referring to FIG. 3 and FIG. 8, in a possible embodiment, the mounting portion 18 includes a clamping portion 90, and the shelf assembly 22 includes a light-guiding glass plate 92, a frame 54 disposed along a rear edge of the glass plate 92, and a pair of covers 94 respectively connected to corresponding ends of the frame 54, the cover 94 is clamped in the clamping portion 90, and the light source 30 is located in the frame 54.

In this way, it can be beneficial to mount the shelf assembly 22 on the mounting portion 18 by means of the cover 94 and the clamping portion 90, and the light emitted by the light source 30 in the frame 54 connected to the rear edge of the glass panel 92 may be guided forward along the glass panel 92.

The glass plate 92 may be rectangular, square, and other forms. The glass panel 92 may have front, rear, left, and right oriented end faces facing the front opening 88, the rear wall 16, the left side wall 14, and right side wall 14 of the storage compartment 12 respectively.

For example, when the frame 54 including the light source 30 is disposed on the rear edge of the glass panel 92, the light emitted by the light source 30 may be incident from the rear end face of the glass panel 92 and at least partially emergent from the front, left, and right end faces. In this case, the rear end face may be an incident end face, and the end faces in the other three directions may be emergent end faces.

In a possible embodiment, the end faces of the glass panel 92 may all be frosted so that the glass panel 92 may not need to distinguish between front and rear sides, and manufacturing may be simpler and the process may be easier to achieve, while the cost of the glass panel 92 may be lower. The lighting effect may be relatively uniform, and scratches and fingerprint soiling can also be avoided.

In some other embodiments, the incident end face of the glass panel 92, such as the rear end face, may be smooth, while the emergent end face, such as the front, left, and right end faces, may be frosted. In this way, the lighting effect of the incident end face may be higher and brighter, while the lighting effect of the emergent end faces may be relatively uniform, and scratches and fingerprint soiling can also be avoided.

An upper surface 93 and a lower surface 97 of the glass panel 92 can present a luminous pattern, such as a luminous LOGO, by printing, laser engraving, stickers, and the like.

Two ends of the frame 54 may be symmetrically provided with a welding platform/gluing groove, and the two covers 94 may each be provided with corresponding welding bars/sealing glue bars to be mounted and fixed to the corresponding ends of the frame 54 respectively.

The clamping portion 90 may be an approximately C-shaped protrusion with a front opening, so that the cover 94 may enter the clamping portion 90 after the shelf assembly 22 is inserted from the front to the rear. The shelf assembly 22 may be unbounded from the rear to the front to the mounting portion 18. The rear edge of the clamping portion 90 may limit further rearward movement of the shelf assembly 22.

The rear edge of the clamping portion 90 may be at a distance from the rear wall 16 in the front-rear direction F, so as to define an extension space between the frame 54 and the rear wall 16 for the portion of the first conductive terminal 24 located outside the frame 54, and to maintain the electrical connection between the first conductive terminal 24 and the power supply terminal unit 34.

Upper and lower edges of the clamping portion 90 may limit unnecessary movement of the shelf assembly 22 in an up and down direction. The front opening of the clamping portion 90 may have portions close to each other, so as to limit unnecessary forward movement of the shelf assembly 22. Referring to FIG. 2, the shape and structure of the cover 94 correspond to an end portion of the frame 54 and the clamping portion 90 respectively, to cover the end portion of the frame 54 and to be accommodated in the clamping portion 90. When the first conductive terminal 24 is compressed so that the shelf assembly 22 has a tendency to move forward away from the rear wall 16, the portions close to each other at the front opening of the clamping portion 90 may be combined with the cover 94 to hold the shelf assembly 22 in place, to limit forward movement of the shelf assembly 22.

The mounting portion 18 may include a support portion extending forward from one side of the opening of the clamping portion 90 to at least partially support a corresponding side edge of the glass panel 92 from below, to prevent the mounting portion 18 from falling down. The two side walls 14 may limit the side-to-side swaying of the shelf assembly 22 and the movement along the lateral direction H.

Referring to FIG. 3, in a possible embodiment, the shelf assembly 22 includes a light-guiding glass plate 92 and a frame 54 disposed along a rear edge of the glass plate 92. The frame 54 includes: a mounting groove 96 for receiving edges of the glass plate 92; a mounting cavity 98 separated from the mounting groove 96; the light source assembly 26 located in the mounting cavity 98; and the first conductive terminal 24 electrically connected to the light source assembly 26. The first conductive terminal 24 extends from an interior of the mounting cavity 98 to an exterior.

In this way, it can be beneficial for the shelf assembly 22 to obtain power and emit light at the rear portion, and the light propagates along the glass panel 92, which contributes to an aesthetically pleasing in appearance and increases the effective space utilization.

In a possible embodiment, the light is emitted from an exposed edge of the glass plate 92. For example, the light may be emitted from the front edge and/or the left and right side edges of the glass plate 92.

Referring to FIG. 2, in a possible embodiment, the mounting cavity 98 is provided with a fixing groove 100 extending along a length direction of the frame 54, and the light source assembly 26 is adapted to be inserted into the fixing groove 100 from an entrance 102 of the fixing groove 100.

In this way, it can be beneficial to facilitate convenient and reliable connection between the light source assembly 26 and the frame 54.

After combined with the frame 54, the cover 94 may cover the entrance 102 of the fixing groove 100 to prevent unnecessary interference and damage to the light source assembly 26 in the fixing groove 100. When the light source assembly 26 needs to be removed, the cover 94 can be first separated from the frame 54 and then the light source assembly 26 can be extracted from the entrance 102.

Figure 9:
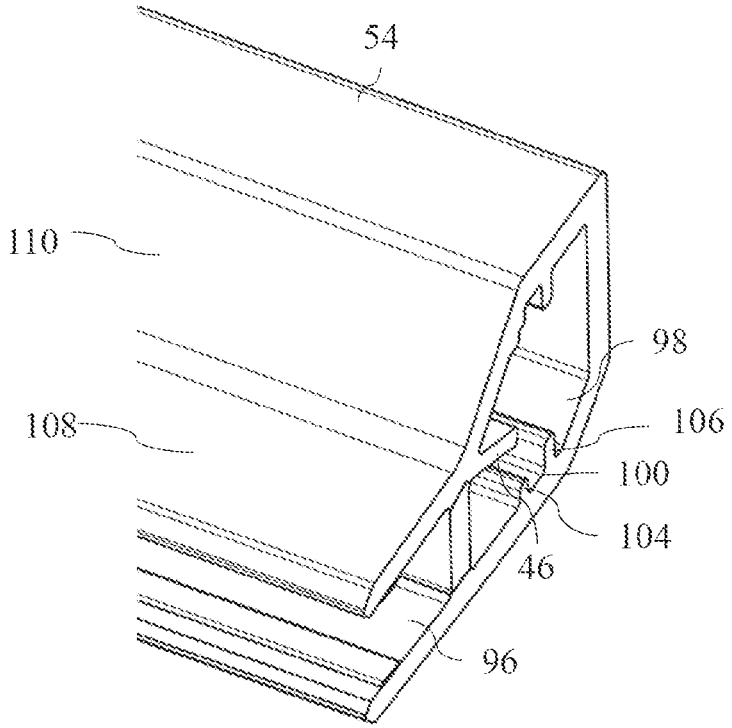
FIG. 9 is a schematic partial enlarged perspective view of a frame of the refrigeration appliance in FIG. 1.

FIG. 9 is a schematic partial enlarged perspective view of a frame of the refrigeration appliance in FIG. 1. Referring to FIG. 9, in a possible embodiment, the fixing groove 100 includes a front groove wall 104 and a rear groove wall 106 which are oppositely disposed, and a height of the front groove wall 104 is less than a height of the rear groove wall 106.

In this way, it can be beneficial for the light source 30 to protrude from the front side of the circuit substrate 28, reducing or eliminating the possibility of blocking the light emitted by the light source 30 when propagating forward.

Still referring to FIG. 3, in a possible embodiment, the first conductive terminal 24 and the light source 30 are staggered in the vertical direction S.

In this way, it can be beneficial to reduce the thickness of the circuit substrate 28 and to prevent mutual interference between the first conductive terminal 24 and the light source 30.

In a possible embodiment, the first conductive terminal 24 is higher than the light source 30 in the vertical direction S.

In this way, it can be beneficial for the first conductive terminal 24 to stagger the glass plate 92, and to reduce the size of the frame in the front-rear direction, and improve the effective space utilization of the shelf assembly 22.

Referring to FIG. 3 and FIG. 9, in a possible embodiment, the shelf assembly 22 includes a light-guiding glass plate 92, and a frame 54 disposed along a rear edge of the glass plate 92, and the frame 54 includes a mounting groove 96 for accommodating the rear edge of the glass plate 92, and a mounting cavity 98 spaced from the mounting groove 96.

The mounting groove 96 includes a horizontal upper wall 108, and the mounting cavity 98 includes an inclined wall 110 adjacent to the upper wall 108.

In this way, it can be beneficial that the glass panel 92 may be staggered from the mounting cavity 98 and at least some of the structures therein, so as to avoid mutual interference.

Referring to FIG. 3, in a possible embodiment, the shelf assembly 22 used for the refrigeration appliance 10 includes a glass panel 92 and a frame 54.

The frame 54 is mounted on at least one side of the glass plate 92. The frame 54 includes a mounting cavity 98, a light source assembly 26, and a first conductive terminal 24.

The light source assembly 26 is located in the mounting cavity 98. The light source assembly 26 includes a circuit substrate 28 and a light source 30 located on the circuit substrate 28.

The first conductive terminal 24 includes a first end 39 located outside the frame 54 and a second end 41 located in the mounting cavity 98 to be electrically connected to the circuit substrate 28.

In this way, it can be beneficial for the shelf assembly 22 to obtain power through the first conductive terminal 24, to supply power to the light source assembly 26 for the light source 30 to emit light.

In a possible embodiment, the shelf assembly 22 includes a second conductive terminal 42 located on the circuit substrate 28, and the first conductive terminal 24 is electrically connected to the second conductive terminal 42.

In this way, it can be beneficial to facilitate convenient and reliable electrical connection between the first conductive terminal 24 and the circuit substrate 28.

In a possible embodiment, the first conductive terminal 24 and the second conductive terminal 42 are plugged and connected along a direction V perpendicular to the circuit substrate 28.

In this way, it can be beneficial to save the space on the circuit substrate 28 and improve the effective space utilization of the frame 54.

In a possible embodiment, the second conductive terminal 42 is located on a first side 44 of the circuit substrate 28 away from the rear wall 16, and the first conductive terminal 24 is connected to the second conductive terminal 42 through the circuit substrate 28.

In this way, it can be beneficial to reduce the space occupied at the rear portion of the circuit substrate 28 by the frame 54.

In a possible embodiment, the shelf assembly 22 includes a retaining wall 46 located between the second conductive terminal 42 and the light source 30 along the vertical direction S.

In this way, it can be beneficial to reduce unnecessary diffusion and leakage of light emitted by the light source 30.

FIG. 4 is a schematic partial enlarged exploded perspective view of the refrigeration appliance in FIG. 1. As shown in FIG. 4, in a possible embodiment, the second conductive terminal 42 includes a mounting portion 48 mounted on the circuit substrate 28 and a holding portion 50 configured to be inserted with the first conductive terminal 24, and at least one side wall 51 of the holding portion 50 is elastic.

In this way, it can be beneficial to facilitate convenient and reliable connection between the first conductive terminal 24 and the second conductive terminal 42.

Figure 10:
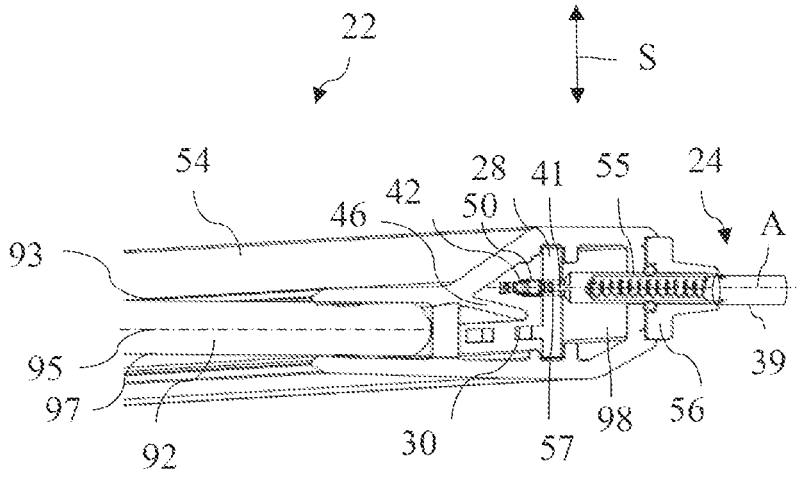
FIG. 10 is a schematic partial enlarged structural view of a shelf assembly of the refrigeration appliance in FIG. 1.

FIG. 10 is a schematic partial enlarged structural view of a shelf assembly of the refrigeration appliance in FIG. 1. As shown in FIG. 10, in a possible embodiment, the frame 54 includes a first through hole 55, the first conductive terminal 24 enters the mounting cavity 98 through the first through hole 55, and the circuit substrate 28 has a second conductive terminal 42 corresponding to the first through hole 55.

In this way, it can be beneficial that the first conductive terminal 24 is partially located outside the frame 54 and partially connected to the second conductive terminal 42 in the frame 54.

In some cases, the projection of the second conductive terminal 42 and the first through hole 55 on the circuit substrate 28 may at least partially overlap.

In a possible embodiment, the circuit substrate 28 has a second through hole 57 corresponding to the first through hole 55, and the projection of the first through hole 55 on the circuit substrate 28 is at least partially located in the second through hole 57.

Referring to FIG. 4, in a possible embodiment, the shelf assembly 22 includes a second conductive terminal 42 connected to the circuit substrate 28, the second conductive terminal 42 is mounted on a second side of the circuit substrate 28 facing the rear wall 16, and the first conductive terminal 24 is electrically connected to the second conductive terminal 42.

In this way, it can be beneficial for the second conductive terminal 42 and the light source 30 to be located on two sides of the circuit substrate 28, reducing and eliminating the possibility of mutual interference.

Still referring to FIG. 3, in a possible embodiment, the first end 39 is adapted to move relative to the frame 54, and the second end 41 is immovably located in the mounting cavity 98.

In this way, it can be beneficial for a margin for the external connection of the first conductive terminal 24, to improve the reliability and convenience of the connection, and to prevent the connection from being impossible or poorly connected due to errors in size, position and the like.

In a possible embodiment, the first conductive terminal 24 includes an elastic member 36 located between the first end 39 and the second end 41.

In this way, it can be beneficial that the first end 39 moves relative to the second end 41.

In a possible embodiment, the first conductive terminal 24 includes a terminal base 38 and a terminal head 40 movable relative to the terminal base 38.

In this way, it can be beneficial for a margin for the external connection of the first conductive terminal 24, to improve the reliability and convenience of the connection, and to prevent the connection from being impossible or poorly connected due to the size error.

In a possible embodiment, the terminal base 38 is fixed on the frame 54 and includes a second end 41.

In this way, it can be beneficial for fixing of the first conductive terminal 24.

In a possible embodiment, the terminal head 40 is adapted to move in a direction V perpendicular to the circuit substrate 28, and/or, the terminal base 38 is perpendicular to the circuit substrate 28 located in the mounting cavity 98.

In this way, it can be beneficial to save the space on the circuit substrate 28 and improve the effective space utilization of the frame 54.

In a possible embodiment, the first conductive terminal 24 includes an elastic member 36 located between the terminal base 38 and the terminal head 40, and the elastic member 36 is adapted to apply a force away from the light source assembly 26 to the terminal head 40.

In this way, it can facilitate reliability of an external connection of the terminal head 40.

The elastic member 36 may be in a compressed state or a stretched state, so that its corresponding resilient force may provide a force away from the light source assembly 26 to the terminal head 40.

In a possible embodiment, the terminal base 38 is in the shape of a hollow tube, and the terminal head 40 is inserted into the terminal base 38 and adapted to move along the terminal base 38.

In this way, it can be beneficial to control the length and width of the first conductive terminal 24, and the movement trajectory of the terminal head 40.

In a possible embodiment, the shelf assembly 22 includes a second conductive terminal 42 disposed on the circuit substrate 28, and the terminal base 38 is electrically connected to the second conductive terminal 42.

In this way, it can be beneficial to facilitate the connection between the first conductive terminal 24 and the circuit substrate 28 through the second conductive terminal 42.

In a possible embodiment, at least one of the first end 39 and the second end 41 of the first conductive terminal 24 is perpendicular to the circuit substrate 28.

In this way, it can be beneficial to save the space on the circuit substrate 28 and improve the effective space utilization of the frame 54.

In a possible embodiment, the first conductive terminal 24 is mounted on an insulator 56, and the insulator 56 is immovably fixed to the frame 54.

In this way, it can be beneficial for fixing and mounting of the first conductive terminal 24. The insulator 56 can be fixed to the frame 54 by ultrasonic welding.

In a possible embodiment, the insulator 56 is fixed on an outer surface of the frame 54 and located outside of the frame 54, and the first conductive terminal 24 extends into the mounting cavity 98 through the insulator 56 and the frame 54.

In this way, it can be beneficial for both the frame 54 and the insulator 56 to provide support for the first conductive terminal 24.

Referring to FIG. 2, in a possible embodiment, the mounting cavity 98 is provided with a fixing groove 100 extending along a length direction of the frame 54, and the light source assembly 26 is adapted to be inserted into the fixing groove 100 from an entrance 102 of the fixing groove 100.

In this way, it can be beneficial for convenient and reliable mounting of the light source assembly 26.

Referring to FIG. 9, in a possible embodiment, the fixing groove 100 includes a front groove wall 104 and a rear groove wall 106 which are oppositely disposed, a height of the front groove wall 104 is less than a height of the rear groove wall 106, the circuit substrate 28 includes an error-proof protrusion 20 (FIG. 2) having a height greater than that of the front groove wall 104 and less than that of the rear groove wall 106.

In this way, it can be beneficial to mount the circuit substrate 28 in the direction of the light source 30 toward the glass panel 92, and to prevent misdirection during mounting of the circuit substrate 28.

Still referring to FIG. 3, in a possible embodiment, the first conductive terminal 24 and the light source 30 are staggered in the vertical direction S.

In this way, it can be beneficial to reduce or eliminate the possibility of mutual interference between the first conductive terminal 24 and the light source 30, and reduce the thickness of the circuit substrate 28.

In a possible embodiment, the first conductive terminal 24 is higher than the light source 30 in the vertical direction S.

In this way, it can be beneficial to reduce or eliminate the possibility of damage to the first conductive terminal 24 in the process of mounting the shelf assembly 22.

In a possible embodiment, the frame 54 includes a mounting groove 96 separated from the mounting cavity 98 and for receiving edges of the glass panel 92, the light source 30 faces the mounting groove 96, and in the vertical direction S, the second end 41 is located above the light source 30.

In this way, it can be beneficial for the light emitted by the light source 30 to propagate to the glass panel 92, and the mounting groove 96 and the first conductive terminal 24 are staggered up and down.

In a possible embodiment, the frame 54 includes a mounting groove 96 for receiving the edges of the glass panel 92 and a light-transmitting portion 31 separating the mounting cavity 98 and the mounting groove 96. The light source 30 faces the light-transmitting portion 31, and main bodies of the light-transmitting portion 31 and the frame 54 are made of different materials.

Except for the light-transmitting portion 31, the rest of the frame 54 may be made of a lightproof material. In this way, it can be beneficial for the propagation of all or most of the light emitted by the light source 30 in the direction of the glass panel 92.

The light-transmitting portion 31 may be made of a material that facilitates light diffusion to improve the uniformity of the light entering the glass panel 92. For example, the light-transmitting portion 31 may be made of a translucent acrylonitrile-butadiene-styrene copolymer (ABS) plastic. The main body of the frame 54 may be made of a lightproof hard plastic.

The light-transmitting portion 31 and the main body of the frame 54 may be formed by a co-extrusion process, so as to enhance the connection strength of the light-transmitting portion 31 and the main body of the frame 54.

The light-transmitting portion 31 may be a wall shared by the mounting groove 96 and the mounting cavity 98. The main body of the frame 54 may be a mounting groove 96 and other component parts of the mounting cavity 98 other than the light-transmitting portion 31.

In a possible embodiment, a method for making the shelf assembly 22 as described herein includes:

- providing a frame 54, where the frame 54 includes a mounting cavity 98 and a first through hole 55 located between two ends of the frame 54, the mounting cavity 98 extends along a length direction of the frame 54 and has at least one entrance 102 located at least one of the two ends of the frame 54, and the first through hole 55 is in communication with the mounting cavity 98;
- inserting a light source assembly 26 into the mounting cavity 98 through an entrance 102, where the light source assembly 26 includes a circuit substrate 28 and a light source 30 located on the circuit substrate 28; and
- inserting a first conductive terminal 24 into the mounting cavity 98 through the first through hole 55 to come into contact with the second conductive terminal 42 located on the circuit substrate 28.

In this way, it can be beneficial to mount the first conductive terminal 24 in contact with the second conductive terminal 42 between the two ends of the frame 54 to establish a reliable connection with the power supply terminal unit 34. Further, in contrast to the prior art where the frame needs to be formed by assembling a plurality of parts in order to mount the circuit substrate and the first conductive terminal, the manufacturing method makes it possible to reduce the quantity of the parts of the frame 54. For example, it becomes possible for the frame 54 to be a single member. The frame 54, especially an upper surface of the frame 54, may be of a seamless structure, and the possibility of liquid or mist entering the mounting cavity 98 to contaminate the electrical member and/or the light-transmitting portion 31 may be significantly reduced.

In a possible embodiment, the refrigeration appliance 10 includes a storage compartment 12 and the shelf assembly 22 mounted in the storage compartment 12 as described herein.

In this way, it can be beneficial for the shelf assembly 22 to obtain power from the storage compartment 12, to emit light within the storage compartment 12 and the like.

In a possible embodiment, the first conductive terminal 24 protrudes toward the rear wall 16 of the storage compartment 12.

In this way, it can be beneficial for the first conductive terminal 24 to obtain power from the rear wall 16, and a user is less likely to reach and see the first conductive terminal 24 when the shelf assembly 22 is located in the storage compartment 12, providing a better experience.

Still referring to FIG. 3, in a possible embodiment, the shelf assembly 22 used for the refrigeration appliance 10 includes a frame 54, a first conductive terminal 24, and a light source assembly 26.

The first conductive terminal 24 includes a first end 39 located outside the frame 54 and a second end 41 located in the frame 54.

The light source assembly 26 includes a circuit substrate 28 at least partially located in the frame 54 and a second conductive terminal 42 mounted on the circuit substrate 28. The second conductive terminal 42 is in contact with the second end 41.

In this way, it can be beneficial for the shelf assembly 22 to obtain power through the first conductive terminal 24, to supply power to the light source assembly 26.

Referring to FIG. 10, in a possible embodiment, the frame 54 includes a first through hole 55, the circuit substrate 28 has a second through hole 57 corresponding to the first through hole 55, the second conductive terminal 42 includes a holding portion 50 corresponding to the first through hole 55 and the second through hole 57, and the first conductive terminal 24 is in contact with the holding portion 50 through the first through hole 55 and the second through hole 57.

In this way, by making the first conductive terminal 24 and the second conductive terminal 42 in contact, a cable connection between the first conductive terminal 24 and the second conductive terminal 42 is no longer required, which can effectively reduce the need to use cables in the frame 54, thereby increasing manufacturing efficiency. In addition, receiving the first conductive terminal 24 by the holding portion 50 makes a plurality of contacts formed between the two, which can be beneficial to ensure reliability and stability of the power obtained by the light source 30.

In a possible embodiment, the second conductive terminal 42 includes a holding portion 50 surrounding the second end 41.

In this way, it can be beneficial to facilitate convenient and reliable connection between the second conductive terminal 42 and the first conductive terminal 24.

Referring to FIG. 4, in a possible embodiment, the second conductive terminal 42 includes a mounting portion 48 mounted on the circuit substrate 28, and the mounting portion 48 extends vertically outward from one end of the holding portion 50.

In this way, it can be beneficial for mounting and fixing of the second conductive terminal 42 to the circuit substrate 28.

The holding portion 50 may be approximately perpendicular to the circuit substrate 28. The mounting portion 48 may be approximately sheet-shaped. In a possible embodiment, the holding portion 50 includes at least one side wall 51 that is elastic, and the at least one side wall 51 is in contact with the second end 41.

In this way, it can be beneficial to improve reliable connection between the first conductive terminal 24 and the second conductive terminal 42.

The elasticity of at least one of the side walls 51 can be beneficial to reduce or eliminate the possibility that the first conductive terminal 24 may not be connected, or may be poorly connected, to the second conductive terminal 42 due to tolerances in size, location and the like.

In a possible embodiment, the quantity of at least one side wall 51 is more than two, and at least two side walls 51 have different heights.

In this way, it can be beneficial to improve reliable connection between the first conductive terminal 24 and the second conductive terminal 42.

Two or more side walls 51 having different heights can be in multi-dimensional contact with the first conductive terminal 24, which can be beneficial to reduce or eliminate the possibility that the first conductive terminal 24 may not be connected, or may be poorly connected, to the second conductive terminal 42 due to tolerances in size, location and the like.

In a possible embodiment, one end of the at least one side wall 51 extends close to each other.

In this way, it can be beneficial to improve reliable connection between the first conductive terminal 24 and the second conductive terminal 42.

At least one of the side wall 51 with one end extending close to each other can be beneficial to increase the possibility of being in contact with the first conductive terminal 24, the gripping force and the like.

In a possible embodiment, the second conductive terminal 42 includes a mounting portion 48 extending outward in two opposite directions from ends of the two longer walls 49 in the at least one side wall 51, and an extending portion 53 extending outward in two opposite directions from opposite ends of the two longer walls 49, and the distance between the ends of the two longer walls 49 connected to the mounting portion 48 is greater than the distance between the opposite ends of the two longer walls 49 connected to the extending portion 53.

In this way, it can be beneficial that the first conductive terminal 24 may enter from the ends of the two longer walls 49 that are more distant and be clamped by the ends of the two longer walls 49 that are less distant. The two longer walls 49 and the extending portion 53 can contribute to the elastic and reliable contact of the second conductive terminal 42 with the first conductive terminal 24.

The mounting portion 48 may be fixed on the circuit substrate 28 to mount the second conductive terminals 42. The two longer walls 49 may be opposite to each other. The two longer walls 49 may extend for a greater length relative to the circuit substrate 28 than that of the other walls of the second conductive terminal 42 relative to the circuit substrate 28. The extending portion 53 may be a free end of the corresponding longer wall 49. The extending portion 53 may have the same shape and size as the mounting portion 48, each being approximately sheet-shaped.

In a possible embodiment, the at least one side wall 51 includes two shorter walls 47 connecting the two longer walls 49, and ends of the two shorter walls 47 extend close to each other.

In this way, it can be beneficial for multi-dimensional contact between the first conductive terminal 24 and the second conductive terminal 42, and the ends of the two shorter walls 47 extending close to each other may provide some gripping force to the first conductive terminal 24.

The lengths of the two longer walls 49 may be the same. The lengths of the two shorter walls 49 may be the same. The lengths of the two longer walls 49 may be greater than the lengths of the two shorter walls 47. The two longer walls 49 and the two shorter walls 47 may each be approximately sheet-shaped. The four may surround at least a portion of, for example, the second end 41 of the first conductive terminal 24 in multidimensional and separated contact, and each applies an elastic gripping force on at least a portion of, for example, the second end 41 of the first conductive terminal 24 at the ends extending close to each other. For example, the two longer walls 49 and the two shorter walls 47 may surround at least a portion of, for example, the second end 41 of the first conductive terminal 24, and may be in contact with the first conductive terminal 24 in four directions. The two longer walls 49 and the two shorter walls 47 may apply an elastic gripping force at two different lengths of the first conductive terminal 24.

In a possible embodiment, the second conductive terminal 42 includes a mounting portion 48 extending in two opposite directions from one end of the holding portion 50 and an extending portion 53 extending in two opposite directions from the other end of the holding portion 50, and the extending portion 53 and the mounting portion 48 extend in the same direction.

In this way, it can be beneficial to enhance the stability of the second conductive terminal 42 located on the circuit substrate 28 and improve the effective utilization of the circuit substrate 28.

Each extending portion 53 and the corresponding mounting portion 48 may be in the same shape, size or be similar sheet-shaped, may extend from two opposite ends of a longer wall 49 in a direction away from the holding portion 50, and may be parallel to each other and parallel to the circuit substrate 28.

Referring to FIG. 3, in a possible embodiment, the shelf assembly 22 includes a glass panel 92 that fits into the frame 54 on at least one side, the light source assembly 26 includes a light source 30 mounted on the circuit substrate 28, and the second conductive terminal 42 and the light source 30 are staggered in the vertical direction S.

In this way, it can be beneficial for the shelf assembly 22 to emit light by means of the light source 30, and to reduce and eliminate the possibility of mutual interference between the second conductive terminal 42 and the light source 30, and reduce the thickness of the circuit substrate 28.

In a possible embodiment, the second conductive terminal 42 is higher than the light source 30 in the vertical direction S.

In this way, it can be beneficial for smooth mounting of the shelf assembly 22.

In a possible embodiment, the first conductive terminal 24 and/or the second conductive terminal 42 are at least partially higher than a lower surface 97 of the glass panel 92. In a possible embodiment, the first conductive terminal 24 and/or the second conductive terminal 42 are at least partially higher than an upper surface 93 of the glass panel 92.

In this way, the first conductive terminal 24 and/or the second conductive terminal 42 and the glass panel 92 are at least partially staggered, so that the freedom of selecting the position of the light source 30 relative to the glass panel 92 can be increased and it can be beneficial to reduce the impact of the first conductive terminal 24 and/or the second conductive terminal 42 on the light into the glass panel 92. For example, a retaining wall 46 may be arranged between the first conductive terminal 24 and/or the second conductive terminal 42 and the light source 30, to block the light into the region where the first conductive terminal 24 and/or the second conductive terminal 42 is located.

In a possible embodiment, the refrigeration appliance 10 includes a storage compartment 12 and the shelf assembly 22 mounted in the storage compartment 12 as described herein.

In this way, it can be beneficial that the refrigeration appliance 10 may supply power to the shelf assembly 22, and the shelf assembly 22 may glow in the storage compartment 12.

In a possible embodiment, the circuit substrate 28 extends parallel to the rear wall 16 of the storage compartment 12.

In this way, it can be beneficial to reduce the size of the frame 54, and improve the effective space utilization of the shelf assembly 22 and the storage compartment 12.

Referring to FIG. 3, in a possible embodiment, the refrigeration appliance 10 includes a storage compartment 12, an inner wall 13, and a power supply terminal unit 34. The inner wall 13 faces the storage compartment 12.

The power supply terminal unit 34 includes a conductive terminal 39 and an insulating housing 68 connected to the inner wall 13. The conductive terminal 69 includes a first connection portion 72 that at least partially covers the insulating housing 68 to be exposed in the storage compartment 12, and a second connection portion 74 that at least partially extends beyond the storage compartment 12. The second connection portion 74 is connected to the first connection portion 72.

In this way, it can be beneficial for the refrigeration appliance 10 to supply power to a power-demanding device 11 such as the shelf assembly 22 in the storage compartment 12 through the inner wall 13.

In a possible embodiment, the first connection portion 72 extends parallel to the inner wall 13.

In this way, it can be beneficial for the convenience of supplying power through the first connection portion 72.

The first connection portion 72 may be approximately sheet-shaped. The surface of the first connection portion 72 toward the storage compartment 12 may be approximately flush with the surface of the inner wall 13 toward the storage compartment 12. In addition, even if the position of the power-demanding device 11 relative to the storage compartment 12 changes with the use of the refrigeration appliance 10, the first connection portion 72 facing the storage compartment 12 may still form a connection with the terminal 24 of the power-demanding device 11 due to the shape of the first connection portion. This is particularly beneficial when the terminal 24 on the power-demanding device 11 is a probe terminal.

In a possible embodiment, the second connection portion 74 extends in a direction away from the storage compartment 12.

In this way, it can be beneficial that the second connection 74 occupies less or even no space in the storage compartment 12, increasing the effective space utilization of the storage compartment 12 and enhancing the neatness and aesthetics of the storage compartment 12.

Figure 11:
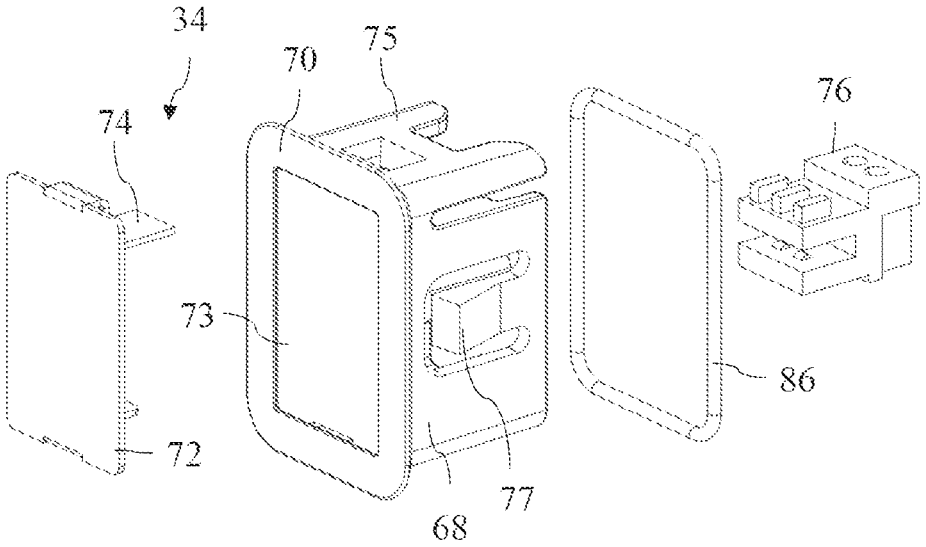
FIG. 11 is a schematic exploded perspective view of a power supply terminal unit and a mating connector of the refrigeration appliance in FIG. 1.

FIG. 11 is a schematic exploded perspective view of a power supply terminal unit and a mating connector of the refrigeration appliance in FIG. 1. Referring to FIG. 11, in a possible embodiment, the second connection portion 74 is perpendicular to the first connection portion 72.

In this way, it can be beneficial to connect the power supply terminal unit 34 externally from mutually perpendicular directions to avoid conflicts or occupying an excessive volume in one direction.

The first connection portion 72 may be approximately a rectangular or square or circular sheet. The second connection portion 74 may extend from a bend in one of the shorter sides of the first connection portion 74. The width of the second connection portion 74 may be less than the width of the shorter side of the connected first connection portion 72. The second connection portion 74 may have an approximately z-shaped cross-section, and may include a first section extending vertically from the first connection portion 72, a middle section extending parallel subsequently, and a final section extending vertically. The final section may be perpendicular to the first connection portion 72 and connected to the mating connector 76.

The mating connector 76 may be a wire end connector (IDC). The mating connector 76 may include a terminal electrically connected to the second connection portion 74.

In a possible embodiment, the insulating housing 68 includes a mounting plate 70, which has an inlay portion 73 inlaid with the first connection portion 72.

In this way, it can be beneficial for fixing and mounting of the first connection portion 72.

The mounting plate 70 may be approximately a rectangular plate. The length, width, and thickness of the mounting plate 70 may be greater than the length, width, and thickness of the first connection portion 72 respectively. The inlay portion 73 may be a recess in a surface of the mounting plate 70. The length, width, and thickness of the inlay portion 73 may be equal to the length, width, and thickness of the first connection portion 72 respectively. After the first connection portion 72 is accommodated in the inlay portion 73, the outer surface of the first connection portion 72 may be flush with the outer surface of the surrounding mounting plate 70.

The insulating housing 68 may include a through hole in communication with the inlay portion 73, to allow the second connection portion 74 to pass through.

Figure 12:
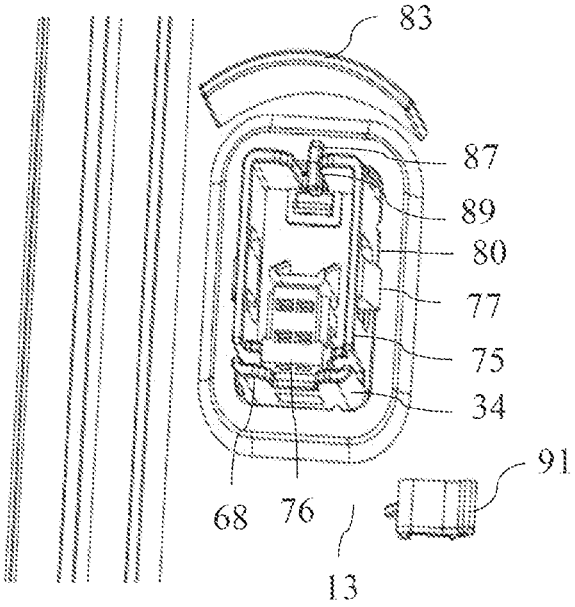
FIG. 12 a schematic partial perspective view of a combination of a power supply terminal unit, a mating connector, and an inner wall of the refrigeration appliance in FIG. 1.

FIG. 12 a schematic partial perspective view of a combination of a power supply terminal unit, a mating connector, and an inner wall of the refrigeration appliance in FIG. 1. Referring to FIG. 12, in a possible embodiment, the insulating housing 68 includes a fitting portion 75 extending out of the storage compartment 12 from the mounting plate 70, and the fitting portion 75 has a buckle portion 77 that is bonded to the inner wall 13.

In this way, it can be beneficial for fixing and mounting of the insulating housing 68 and the inner wall 13.

The length and width of the fitting portion 75 may be less than the length and width of the mounting plate 70. The thickness of the fitting portion 75 may be greater than the thickness of the mounting plate 70.

Figure 13:
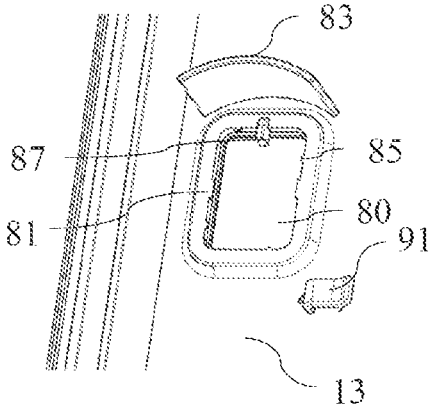
FIG. 13 is similar to FIG. 12, but shows an inner wall only.

FIG. 13 is similar to FIG. 12, but shows an inner wall only. Referring to FIG. 13, in a possible embodiment, the inner wall 13 includes an opening 80 for mounting the power supply terminal unit 34 and a protrusion 81 extending into the opening 80, and the protrusion 81 fits with a buckle 77.

In this way, it can be beneficial for fixing and mounting of the power supply terminal unit 34 and the inner wall 13.

There may be a pair of protrusions 81, which are located at opposite edges of the opening 80 in a length direction. The buckle portion 77 may be arranged corresponding to the protrusion 81. The buckle portion 77 may have some inclination and elasticity, and may spring back after penetrating from the storage compartment 12 to the opposite side of the inner wall 13 through the opening 80, and abut against the protrusion 81 and the corresponding edge of the opening 80, so that the inner wall 13 may be clamped between the mounting plate 70 and the buckle portion 77, to prevent the power supply terminal unit 34 from falling off from the inner wall 13.

In a possible embodiment, the inner wall 13 includes an opening 80 for mounting the power supply terminal unit 34, and a water retaining rib 83 arranged apart from the opening 80.

In this way, it can be beneficial to avoid the impact such as a short circuit caused by water and other solutions on the power supply terminal unit 34.

The water retaining rib 83 may be adjacent to one side of the edge of the opening 80, may protrude from the side of the inner wall 13 that is away from the storage compartment 12, and may be similar to an arc-shaped sheet-shaped shed. The water retaining rib 83 may be located above the opening 80.

In a possible embodiment, the inner wall 13 includes an opening 80 for mounting the power supply terminal unit 34 and a limiting portion 85 extending into the opening 80.

In this way, it can be beneficial for fixing and mounting of the power supply terminal unit 34 and the inner wall 13.

The limiting portion 85 may project from the edge of the opening 80 and may be in contact with, for example, the fitting portion 75 of the power supply terminal unit 34, and can contribute to enhancing the bonding force of the power supply terminal unit 34 to the inner wall 13.

In a possible embodiment, the inner wall 13 includes an opening 80 for mounting the power supply terminal unit 34, one of the opening 80 and the power supply terminal unit 34 includes an error-proof rib 87, and the other includes an error-proof groove 89 matched with the error-proof rib 87.

In this way, it can be beneficial for correct mounting of the power supply terminal unit 34, to prevent wrong mounting and reverse mounting, so that the corresponding wire harness (not shown) of the mating connector 76 has the correct outlet direction, such as a downward direction.

In a possible embodiment, the inner wall 13 includes an opening 80 for mounting the power supply terminal unit 34, and a line card 91 arranged apart from the opening 80.

In this way, for example, it can be beneficial for the wire harness (not shown) connected to the power supply terminal unit 34 to be sorted and limited by the line card 91. The line card 91 may be located at the lower and side part of the opening 80.

The mating connector 76 connected to the power supply terminal unit 34 may be a wire end connector whose wire harness (not shown) may be sorted and limited by the line card 91.

Still referring to FIG. 3, in a possible embodiment, the refrigeration appliance 10 includes an air duct cover 30, the inner wall 13 is located on the air duct cover 60, and the second connection portion 74 extends to a rear portion of the air duct cover 60 through the insulating housing 68.

In this way, it can be beneficial to mount the power supply terminal unit 34 on the air duct cover 60, and reduce or eliminate the possibility and necessity of mold and process changes for larger components such as the liner of the refrigeration appliance 10.

Referring to FIG. 6, in a possible embodiment, the insulating housing 68 includes a plug portion 78 fixed on the second connection portion 74 to be plugged with the mating connector 76.

In this way, it can be beneficial to facilitate reliable connection between the power supply terminal unit 34 and the mating connector 76.

The plug portion 78 may be in the form of an approximate plate corresponding to the second connection portion 74, may be in contact with the second connection portion 74 on one side, and may support the second connection portion 74.

Still referring to FIG. 3, in a possible embodiment, the refrigeration appliance 10 includes a power-demanding device 11 adapted to move relative to the storage compartment 12 or removable from the storage compartment 12, the power-demanding device 11 includes a first conductive terminal 24 in the form of a probe, the first connection portion 72 is sheep-shaped, and the first conductive terminal 24 abuts against the first connection portion 72.

In this way, it can be beneficial for the refrigeration appliance 10 to supply power to the power-demanding device 11 in a simple and reliable way, and the inner wall 13 can be flat and have a better appearance.

The inner wall 13 may be one or more of the rear wall 16, the side wall 14, the top wall, and the bottom wall of the storage compartment 12.

One example of the power-demanding device 11 may be the shelf assembly 22.

Figure 14:
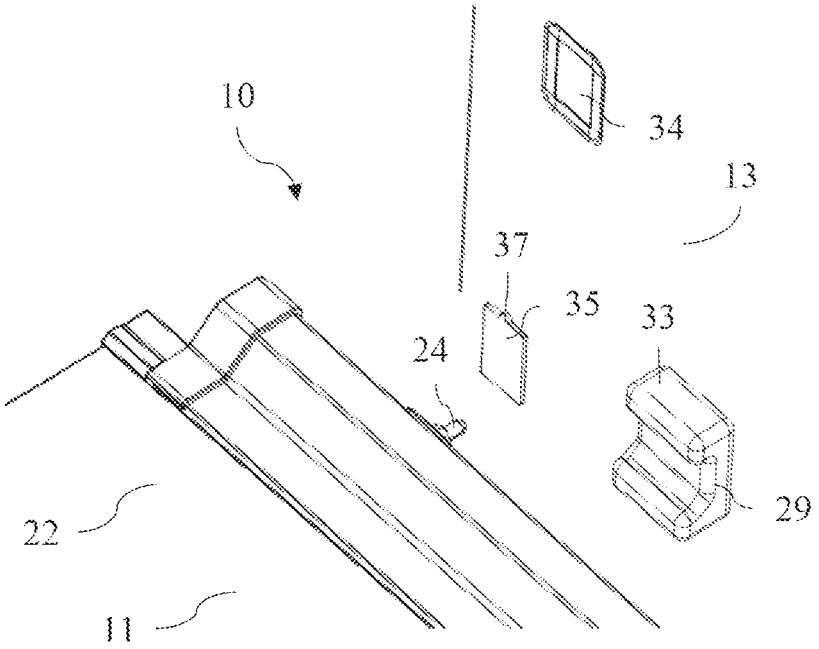
FIG. 14 is a schematic partial enlarged exploded perspective view of the refrigeration appliance in FIG. 1.

FIG. 14 is a schematic partial enlarged exploded perspective view of the refrigeration appliance in FIG. 1. Referring to FIG. 14, in a possible embodiment, the refrigeration appliance 10 includes a protective sheet 35 that removably covers the first connection portion 72.

In this way, it can be beneficial to reduce the possibility of scratches, abrasions, and damage on the first connection portion 72 during the manufacturing, transportation, and storage of the refrigeration appliance 10.

The protective sheet 35 may correspond to the size and shape of the first connection portion 72, to at least partially cover the first connection portion 72. The protective sheet 35 and the first connection portion 72 may be combined by adhesion or the like. In a possible embodiment, the protective sheet 35 includes a removal portion 37.

In this way, the protective sheet 35 can be separated from the first connection portion 72 by means of the removal portion 37.

The removal portion 37 may be a protruding portion of an edge of the protective sheet 35. The removal portion 27 may not be combined with the first connection portion 72.

In a possible embodiment, the refrigeration appliance 10 includes a power-demanding device 11 adapted to move relative to the storage compartment 12 or removable from the storage compartment 12, the power-demanding device 11 includes a first conductive terminal 24, and the protective sheet 35 is located between the first conductive terminal 24 and the power supply terminal unit 34 and electrically connects the first conductive terminal 24 and the power supply terminal unit 34.

In this way, it can be beneficial to detect the performance of the refrigeration appliance 10 in supplying power to the power-demanding device 11, for example, without removing the protective sheet 35 in the process of manufacturing the refrigeration appliance 10, and to reduce and eliminate the impact on the manufacturing process of the refrigeration appliance 10.

One example of the power-demanding device 11 may be the shelf assembly 22.

In a possible embodiment, the thickness of the protective sheet 35 ranges from 0.2 mm to 1 mm.

In this way, it can be beneficial to, on one hand, ensure reliability and prevent the protective sheet 35 from being worn out, and one the other hand, prevent excessive compression of the connection space of the first conductive terminal 24 and the power supply terminal unit 34, for example, excessive compression of the terminal head 40 and the elastic member 36 of the first conductive terminal 24, which generates a hard collision and damages the first conductive terminal 24 and the power supply terminal unit 34.

The values in this application may include values within the error range of measurements, metrology, and the like.

The error range may be plus or minus five percent. For example, 1 mm may include 0.95 mm, 0.97 mm, 1 mm, 1.02 mm, 1.05 mm, and the like.

The range of values in this application may include any subrange thereof. For example, 0.2 mm to 1 mm may include 0.2 mm to 0.3 mm, 0.4 mm to 0.8 mm, 0.5 mm to 0.9 mm, 0.6 mm to 1 mm, and so on.

In a possible embodiment, the refrigeration appliance 10 includes a guard member 33 removably disposed on the inner wall 13, and the guard member 33 and the power supply terminal unit 34 are spaced apart.

In this way, it can be beneficial to limit the relative position between the first conductive terminal 24 and the power supply terminal unit 34, and to optimize the stability of the connection between the first conductive terminal 24 and the power supply terminal unit 34.

Figure 15:
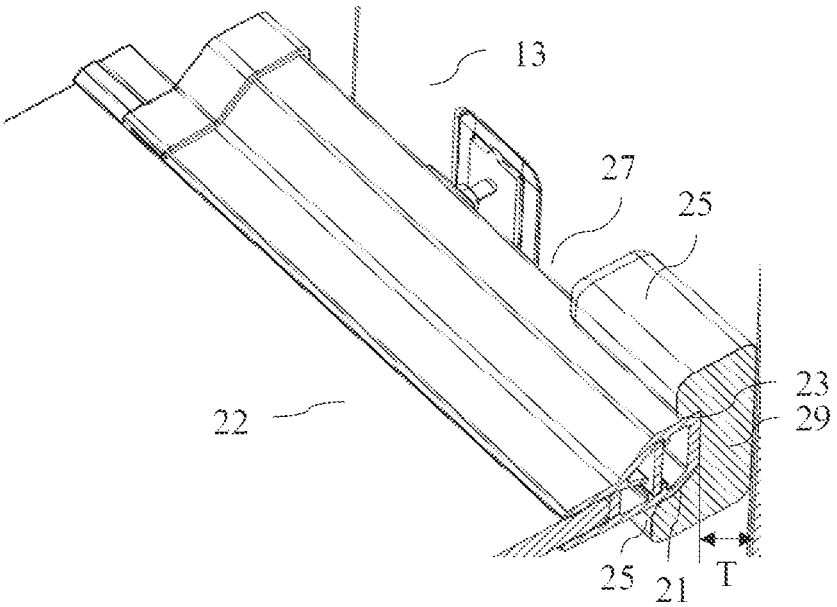
FIG. 15 is a schematic partial sectional view of the assembly in FIG. 14.

FIG. 15 is a schematic partial sectional view of the assembly in FIG. 14. As shown in FIG. 15, in a possible embodiment, the refrigeration appliance 10 includes a shelf assembly 22, the guard member 33 includes a gripping portion 29 clamped between the shelf assembly 22 and the inner wall 13, and a thickness T is greater than a gap 27 between the shelf assembly 22 and the inner wall 13.

In this way, it can facilitate an interference fit to eliminate design and assembly gaps and to prevent shaking from causing strike and abrasions to the connection between the shelf assembly 22 and the inner wall 13, and the connection between the first conductive terminal 24 and the power supply terminal unit 34.

In a possible embodiment, the guard member 33 includes a bent portion 25 bent from ends of the gripping portion 29 and extending toward the shelf assembly 22, and the bent portion 25 is in contact with the first contact surface 23 and the second contact surface 21 of the shelf assembly 22 that are opposite to each other.

In this way, it can be beneficial to limit the movement of the shelf assembly 22 back and forth in a direction parallel to the inner wall 13.

Referring to FIG. 1, in a possible embodiment, the refrigeration appliance 10 includes a removal tip zone 15.

In this way, it can be beneficial to remove the protective sheet 35 and/or the guard member 33 according to hints of the removal tip zone 15 when needed, for example, when the user starts using the refrigeration appliance 10.

The removal tip zone 15 may be arranged in a location visible to the user, such as an unshaded part of the inner wall 13.

In a possible embodiment, there are a plurality of power supply terminal units 34, which are arranged separately.

In this way, it can be beneficial for the refrigeration appliance 10 to be powered at a plurality of separated positions, improving the flexibility and convenience of power supply.

Referring to FIG. 1, in a possible embodiment, the refrigeration appliance 10 includes a storage compartment 12 and a shelf assembly 22. The shelf assembly 22 is mounted on the storage compartment 12. The shelf assembly 22 includes a glass panel 92, a frame 54, and a first conductive terminal 24.

Referring to FIG. 10, the glass panel 92 is provided with a central surface 95. The frame 54 is arranged on at least one side of the glass panel 92. The first conductive terminal 24 is arranged on the frame 54 and includes a first end 39 extending out of the frame 54. The first end 39 is adapted to move along an axis A in a direction away from or close to the glass panel 92. The axis A and the central surface 95 are staggered with each other in a vertical direction S.

In this way, it can be beneficial to reduce or eliminate the possibility of mutual interference between the glass panel 92 and the first conductive terminal 24, to control the size of the shelf assembly 22 in the horizontal direction, and to facilitate the mounting of the shelf assembly 22.

In a possible embodiment, the axis A is higher than the central surface 95 in the vertical direction S.

In this way, it can be beneficial for mounting of the shelf assembly 22.

In a possible embodiment, the glass panel 92 includes an upper surface 93, which is lower than the axis A in the vertical direction S.

In this way, it can be beneficial to reduce or eliminate the possibility of mutual interference between the glass panel 92 and the first conductive terminal 24, to control the size of the shelf assembly 22 in the horizontal direction, and to facilitate the mounting of the shelf assembly 22.

In a possible embodiment, the shelf assembly 22 includes a retaining wall 46 that is higher than the central surface 95 in the vertical direction S.

In this way, it can be beneficial for convenient processing and manufacturing of the shelf assembly 22.

In a possible embodiment, the shelf assembly 22 includes a retaining wall 46 that is lower than the axis A in the vertical direction S.

In this way, it can be beneficial to reduce or eliminate the possibility of mutual interference between the first conductive terminal 24 and the retaining wall 46, to control the size of the shelf assembly 22 in the horizontal direction.

The retaining wall 46 may extend toward the first conductive terminal 24.

In a possible embodiment, the shelf assembly 22 includes a light source 30, and has a projection in the vertical direction S within the thickness range of the glass panel 92.

In this way, it can be beneficial for the propagation of all or most of the light emitted by the light source 30 in the direction of the glass panel 92.

In a possible embodiment, the shelf assembly 22 includes a circuit substrate 28 and a light source 30 disposed on the circuit substrate 28. The first conductive terminal 24 includes a second end 41 connected to the circuit substrate 28, and the second end 41 and the light source 30 are staggered from each other in the vertical direction S.

In this way, it can be beneficial for the first conductive terminal 24 to supply power to the light source 30 through the circuit substrate 28, and the circuit substrate 28 is less thick, and it is less likely that the first conductive terminal 24 interferes with the light source 30.

In a possible embodiment, the shelf assembly 22 includes a circuit substrate 28 having a height in the vertical direction S that is greater than the thickness of the glass panel 92 in the vertical direction S.

In this way, for example, the second conductive terminals 42, the first conductive terminals 24, and the glass panel 92 that are mounted and connected on the circuit substrate 28 are staggered from each other in the vertical direction S.

In a possible embodiment, the glass panel 92 and the first conductive terminal 24 are arranged apart from the frame 54.

In this way, it can be beneficial for the reliable structure of the frame 54, reducing or eliminating the possibility of mutual interference of the frame 54 on the glass panel 92 and the first conductive terminal 24.

In a possible embodiment, the frame 54 includes: a mounting groove 96 for receiving edges of the glass panel 92, and a mounting cavity 98 for mounting the first conductive terminal 24. A maximum height of the mounting cavity 98 in the vertical direction S is greater than a maximum height of the mounting groove 96 in the vertical direction S.

In this way, it can be beneficial that the first conductive terminal 24 and the glass panel 92 may be staggered in the vertical direction S.

The maximum height of the mounting cavity 98 in the vertical direction S may be a height between its lowest point and its highest point. The maximum height of the mounting groove 96 in the vertical direction S may be a height between its lowest point and its highest point.

Referring to FIG. 1, in a possible embodiment, the refrigeration appliance 10 includes a storage compartment 12 and a shelf assembly 22. The shelf assembly 22 is mounted on the storage compartment 12.

Referring to FIG. 10, the shelf assembly 22 includes a glass panel 92, a frame 54, and a light source 30. The glass panel 92 is provided with an upper surface 93 and a lower surface 97 opposite to the upper surface 93. The frame 54 is mounted on at least one side of the glass panel 92. The light source 30 is disposed in the frame 54 and has a projection in the vertical direction S located between the upper surface 93 and the lower surface 97.

In this way, it can be beneficial that all or most of the light emitted by the light source 30 may propagate toward the glass panel 92, reducing the loss of light in other directions.

Referring to FIG. 3, in a possible embodiment, the frame 54 includes a light-transmitting portion 31, which is located between the light source 30 and the glass panel 92.

In this way, it can be beneficial for the light emitted by the light source 30 to propagate more toward the glass panel 92 than in other directions.

The light-transmitting portion 31 may be made of a material that facilitates light diffusion to improve the uniformity of the light entering the glass panel 92. For example, the light-transmitting portion 31 may be made of a translucent acrylonitrile-butadiene-styrene copolymer (ABS) plastic. The other parts of the frame 54 may be made of a lightproof hard plastic.

In a possible embodiment, the frame 54 includes a retaining wall 46 extending toward the light source 30 from a height above the upper surface 93.

In this way, it can be beneficial to at least partially block the light emitted by the light source 30, reducing or eliminating the possibility of propagation in a direction higher than the glass panel 92.

Referring to FIG. 9, in a possible embodiment, the frame 54 includes an upper wall 108 in contact with the upper surface 93, an inclined wall 110 adjacent to the upper wall 108, and a retaining wall 46 extending from the joint of the upper wall 108 and the inclined wall 110 toward the light source 30.

In this way, it can be beneficial for convenient processing of the frame 54, and the vertical misalignment of the glass panel 92 with at least part of the structure of the frame 54, to control the size of the frame 54 in the horizontal direction.

In a possible embodiment, the frame 54 includes: a mounting groove 96 for receiving a edges of the glass panel 92, a mounting cavity 98 for mounting the light source 30, and a light-transmitting portion 31 spaced between the mounting groove 96 and the mounting cavity 98.

In this way, it can be beneficial that there is little or no possibility of mutual interference between the light source 30 and the glass panel 92, and that the light emitted by the light source 30 tends to propagate toward the glass panel 92.

The light-transmitting portion 31 may be a wall shared by the mounting groove 96 and the mounting cavity 98. The light diffusion performance of the light-transmitting portion 31 may be higher than that of the rest parts of the mounting groove 96 and the mounting cavity 98.

The various embodiments described above and shown in the drawings are only used to illustrate the present invention, but not all of the present invention. Any person skilled in the art may make modifications in any form of this application without departing from the scope of the technical means and ideas of this application shall fall within the protection scope of this application.

What is claimed is:

1. A refrigeration appliance, comprising:

a storage compartment having a pair of oppositely-disposed side walls, a rear wall disposed between said side walls, a front-rear direction and a rear portion, each of said side walls including a respective mounting portion;

a shelf assembly mounted on said storage compartment by said mounting portions, said shelf assembly configured to carry out a movement along said front-rear direction being limited by said mounting portions, said shelf assembly including at least two first conductive terminals, and said at least two first conductive terminals being located at said rear portion;

a light source assembly including a circuit substrate and a light source located on said circuit substrate, said light source assembly being disposed on said shelf assembly;

a power supply portion located at said rear portion of said storage compartment for supplying power to said light source, said power supply portion including power supply terminal units each disposed in a vicinity of a respective one of said side walls, said power supply terminal units being disposed on said rear wall, and each of said at least two first conductive terminals maintaining electrical connection with said respective power supply terminal units by said mounting portions; and a second conductive terminal connected to said circuit substrate;

said at least two first conductive terminals and said second conductive terminal being plugged and connected along a direction perpendicular to said circuit substrate;

said second conductive terminal being located on a first side of said circuit substrate facing away from said rear wall; and said at least two first conductive terminals being connected to said second conductive terminal through said circuit substrate.

2. The refrigeration appliance according to claim 1, which further comprises an elastic member located in said shelf assembly, said at least two first conductive terminals each maintaining electrical connection with a respective one of said power supply terminal units under action of said elastic member.

3. The refrigeration appliance according to claim 2, wherein said elastic member is one of at least two elastic members, and each of said at least two first conductive terminals includes a respective one of said at least two elastic members.

4. The refrigeration appliance according to claim 3, wherein each of said at least two first conductive terminals includes a terminal base and a terminal head movable relative to said terminal base, and each of said terminal heads abuts against a respective one of said power supply terminal units under action of a respective one of said elastic members.

5. The refrigeration appliance according to claim 4, wherein each of said at least two first conductive terminals includes a respective one of said at least two elastic members located between said terminal base and said terminal head, and said at least two elastic members are adapted to apply a force acting toward a respective one of said power supply terminal units to said terminal head, causing said terminal head to abut against said power supply terminal unit.

6. The refrigeration appliance according to claim 4, wherein said terminal base has a hollow tube shape, and said terminal head is inserted into said terminal base and adapted to move along said terminal base.

7. The refrigeration appliance according to claim 4, which further comprises a second conductive terminal disposed on said circuit substrate, said terminal base being electrically connected to said second conductive terminal.

8. The refrigeration appliance according to claim 1, wherein said first conductive terminal is perpendicular to said circuit substrate.

9. The refrigeration appliance according to claim 1, which further comprises a second conductive terminal connected to said circuit substrate, said second conductive terminal being mounted on a second side of said circuit substrate facing toward said rear wall, and said at least two first conductive terminals being electrically connected to said second conductive terminal.

10. The refrigeration appliance according to claim 1, which further comprises a second conductive terminal connected to said circuit substrate, said at least two first conductive terminals and said second conductive terminal being plugged and connected along a direction perpendicular to said circuit substrate on which said light source is mounted.

11. A refrigeration appliance, comprising:

a storage compartment having a pair of oppositely-disposed side walls, a rear wall disposed between said side walls, a front-rear direction and a rear portion, each of said side walls including a respective mounting portion;

a shelf assembly mounted on said storage compartment by said mounting portions, said shelf assembly configured to carry out a movement along said front-rear direction being limited by said mounting portions, said shelf assembly including at least two first conductive terminals, and said at least two first conductive terminals being located at said rear portion;

a light source assembly including a circuit substrate and a light source located on said circuit substrate, said light source assembly being disposed on said shelf assembly;

a power supply portion located at said rear portion of said storage compartment for supplying power to said light source, said power supply portion including power supply terminal units each disposed in a vicinity of a respective one of said side walls, said power supply terminal units being disposed on said rear wall, and each of said at least two first conductive terminals maintaining electrical connection with said respective power supply terminal units by said mounting portions;

a second conductive terminal connected to said circuit substrate;

said at least two first conductive terminals and said second conductive terminal being plugged and connected along a direction perpendicular to said circuit substrate; and said shelf assembly including a retaining wall located between said second conductive terminal and said light source along a vertical direction.

12. A refrigeration appliance, comprising:

a storage compartment having a pair of oppositely-disposed side walls, a rear wall disposed between said side walls, a front-rear direction and a rear portion, each of said side walls including a respective mounting portion;

a shelf assembly mounted on said storage compartment by said mounting portions, said shelf assembly configured to carry out a movement along said front-rear direction being limited by said mounting portions, said shelf assembly including at least two first conductive terminals, and said at least two first conductive terminals being located at said rear portion;

a light source assembly including a circuit substrate and a light source located on said circuit substrate, said light source assembly being disposed on said shelf assembly;

a power supply portion located at said rear portion of said storage compartment for supplying power to said light source, said power supply portion including power supply terminal units each disposed in a vicinity of a respective one of said side walls, said power supply terminal units being disposed on said rear wall, and each of said at least two first conductive terminals maintaining electrical connection with said respective power supply terminal units by said mounting portions;

a second conductive terminal connected to said circuit substrate;

said at least two first conductive terminals and said second conductive terminal being plugged and connected along a direction perpendicular to said circuit substrate;

said second conductive terminal including a mounting portion mounted on said circuit substrate and a holding portion configured to be inserted with said at least two first conductive terminal, and said holding portion has having at least one elastic side wall.

13. A refrigeration appliance, comprising:

a storage compartment having a pair of oppositely-disposed side walls, a rear wall disposed between said side walls, a front-rear direction and a rear portion, each of said side walls including a respective mounting portion;

a shelf assembly mounted on said storage compartment by said mounting portions, said shelf assembly configured to carry out a movement along said front-rear direction being limited by said mounting portions, said shelf assembly including at least two first conductive terminals, and said at least two first conductive terminals being located at said rear portion;

a light source assembly including a circuit substrate and a light source located on said circuit substrate, said light source assembly being disposed on said shelf assembly;

a power supply portion located at said rear portion of said storage compartment for supplying power to said light source, said power supply portion including power supply terminal units each disposed in a vicinity of a respective one of said side walls, said power supply terminal units being disposed on said rear wall, and each of said at least two first conductive terminals maintaining electrical connection with said respective power supply terminal units by said mounting portions; and an insulator, said shelf assembly including a frame for accommodating said light source, said at least two first conductive terminals being mounted on said insulator, and said insulator being immovably fixed to said frame.

* * * * *